US011971213B2

(12) United States Patent
Tachibana et al.

(10) Patent No.: US 11,971,213 B2
(45) Date of Patent: Apr. 30, 2024

(54) CONTAINER-CONTAINED BEVERAGE TEMPERATURE ADJUSTMENT APPARATUS AND HEAT TRANSFER MEMBER

(71) Applicant: TEX E.G. CO., LTD., Tokyo (JP)

(72) Inventors: Hideki Tachibana, Tokyo (JP); Hiroyuki Matsumoto, Tokyo (JP)

(73) Assignee: TEX E.G. CO., LTD., Tokyo (JP)

( * ) Notice: Subject to any disclaimer, the term of this patent is extended or adjusted under 35 U.S.C. 154(b) by 48 days.

(21) Appl. No.: 17/095,623

(22) Filed: Nov. 11, 2020

(65) Prior Publication Data

US 2021/0063081 A1 Mar. 4, 2021

Related U.S. Application Data

(63) Continuation of application No. PCT/JP2019/018516, filed on May 9, 2019.

(30) Foreign Application Priority Data

May 16, 2018 (JP) ..... 2018-094969

(51) Int. Cl.
*F25D 31/00* (2006.01)

(52) U.S. Cl.
CPC .... *F25D 31/007* (2013.01); *F25D 2303/0821* (2013.01); *F25D 2303/08222* (2013.01); *F25D 2331/803* (2013.01)

(58) Field of Classification Search
CPC ..... F25D 31/007; F25D 2303/0821; F25D 2303/08222; F25D 2331/803;
(Continued)

(56) References Cited

U.S. PATENT DOCUMENTS 6,189,688 B1 * 2/2001 Aneas ..... B65D 25/08 206/219
6,484,514 B1 * 11/2002 Joseph et al. ..... F25D 31/007 62/4
(Continued)

FOREIGN PATENT DOCUMENTS

CN 1343241 A 4/2002
CN 1683468 A * 10/2005 ..... C09K 5/14
(Continued)

OTHER PUBLICATIONS

WO2015190515A1 Dec. 2015 Translation.*
(Continued)

*Primary Examiner* — Elizabeth J Martin
*Assistant Examiner* — Dario Antonio Deleon
(74) *Attorney, Agent, or Firm* — Seed IP Law Group LLP

(57) ABSTRACT

A container-contained beverage temperature adjustment apparatus includes a heat transfer member capable of abutting a part of a side surface of a container-contained beverage as an object of temperature adjustment. The apparatus further includes a temperature adjustment unit configured to adjust a temperature of the container-contained beverage through the heat transfer member, which may include a deformable bag body, and heat transfer powder and heat transfer liquid contained in the bag body. The heat transfer liquid is a liquid which freezes at a temperature higher than a target temperature.

20 Claims, 12 Drawing Sheets

(58) Field of Classification Search
CPC ..... F25D 2303/0841; F25D 2331/809; F25D 16/00; F25D 11/00; F25D 3/02; F25B 2321/0212; F25B 21/02; B22F 1/00; F28D 20/021
See application file for complete search history.

(56) References Cited

U.S. PATENT DOCUMENTS

| | | | | |
|---|---|---|---|---|
| 8,919,138 | B2 * | 12/2014 | Kobayashi | F25B 21/02 62/3.2 |
| 2001/0025510 | A1 | 10/2001 | Maier-Laxhuber et al. | |
| 2004/0206491 | A1 * | 10/2004 | Davidson et al. | C09K 5/10 165/185 |
| 2005/0107855 | A1 * | 5/2005 | Lennox et al. | A61F 7/10 607/104 |
| 2006/0162344 | A1 | 7/2006 | Scudder et al. | |
| 2008/0053109 | A1 * | 6/2008 | Quincy et al. | A61F 7/10 607/114 |
| 2017/0153054 | A1 * | 6/2017 | Sawada et al. | F25D 3/08 |
| 2017/0167716 | A1 * | 6/2017 | Ezaki et al. | F21V 29/87 |
| 2018/0036202 | A1 * | 2/2018 | Wengreen et al. | F25D 3/08 |

FOREIGN PATENT DOCUMENTS

| | | | | | |
|---|---|---|---|---|---|
| CN | 101418210 | A | | 4/2009 | |
| CN | 101712115 | B | * | 5/2011 | B23P 15/26 |
| CN | 102159909 | A | | 8/2011 | |
| CN | 103662415 | A | | 3/2014 | |
| CN | 103897665 | A | | 7/2014 | |
| CN | 112074697 | A | | 12/2020 | |
| DE | 197 53 036 | A1 | | 5/1999 | |
| EP | 0696630 | A2 | | 2/1996 | |
| EP | 1 188 995 | A1 | | 3/2002 | |
| EP | 2327944 | A1 | | 6/2011 | |
| EP | 3795929 | A1 | | 3/2021 | |
| FR | 2 759 774 | A1 | | 8/1998 | |
| FR | 2 793 007 | A1 | | 11/2000 | |
| FR | 2840393 | A1 | * | 12/2003 | F25D 31/007 |
| FR | 2 842 289 | A1 | | 1/2004 | |
| JP | 61-205793 | A | | 9/1986 | |
| JP | S61205793 | A | | 9/1986 | |
| JP | S61205793 | U | | 12/1986 | |
| JP | 5-196333 | A | | 8/1993 | |
| JP | 2000-291967 | A | | 10/2000 | |
| JP | 2001-61882 | A | | 3/2001 | |
| JP | 2002-93970 | A | | 3/2002 | |
| JP | 2004-43787 | A | | 2/2004 | |
| JP | 2004-69148 | A | | 3/2004 | |
| JP | 2004-212029 | A | | 7/2004 | |
| JP | 2004212029 | A | * | 7/2004 | F25B 21/04 |
| JP | 2007285627 | A | | 11/2007 | |
| JP | 2010-47313 | A | | 3/2010 | |
| JP | 2010-251677 | A | | 11/2010 | |
| JP | 2010251677 | A | * | 11/2010 | F28D 20/02 |
| JP | 2015507933 | A | * | 3/2015 | F25D 3/08 |
| JP | WO 2015093311 | A1 | * | 6/2015 | F25D 3/08 |
| JP | WO2015190515 | A1 | * | 12/2015 | F25D 3/00 |
| JP | 2016-7419 | A | | 1/2016 | |
| JP | 2016-118373 | A | | 6/2016 | |
| KR | 10-1295619 | B1 | | 8/2013 | |
| KR | 20170140717 | A | * | 12/2017 | F25B 21/02 |
| WO | WO 9416607 | A2 | | 8/1994 | |
| WO | 03/101884 | A1 | | 12/2003 | |
| WO | 2015/190515 | A1 | | 12/2015 | |
| WO | 2016/084634 | A1 | | 6/2016 | |

OTHER PUBLICATIONS

JP2010251677A Nov. 2010 Translation.*
CN101712115B May 2011 Translation.*
JP 2004212029 A Translation (Year: 2004).*
WO 2015093311 A1 Translation (Year: 2015).*
JP 2015507933 A Translation (Year: 2015).*
FR 2840393 A1 Translation (Year: 2003).*
KR 20170140717 A Translation (Year: 2017).*
CN 1683468 A Translation (Year: 2005).*
International Preliminary Report on Patentability and Written Opinion, dated Nov. 17, 2020, in International Application No. PCT/JP2019/018516, 14 pages (with English translation).
Office Action dated Jul. 27, 2021, in corresponding Chinese Application No. 201980028898.4, 14 pages (with English translation).
International Search Report issued in International Application No. PCT/JP2019/018516, dated Jul. 2, 2019, 2 pages.
Notice of Reasons for Refusal issued in Japanese Application No. 2018-094969, dated Jan. 22, 2019, 8 pages [with machine translation].
Decision of Refusal issued in Japanese Application No. 2018-094969, dated Jun. 4, 2019, 10 pages [with machine translation].
Notice of Reasons for Refusal dated May 9, 2022, in Japanese Patent Application No. 2019-163449 (10 pages) (with English translation).
Office Action dated Jan. 10, 2022, for Chinese Patent Application No. 201980028898.4 (13 pages) (with English Translation).
Extended European Search Report dated Jan. 12, 2022, for European Application No. 19802749.2 (8 pages).
EP Office Action dated Jan. 11, 2024 from EP 19802749.2 (6 pages).
CN Office Action dated Nov. 14, 2023 from CN 202210801739.7 (with English translation; 16 pages).

* cited by examiner

| SAMPLE | Heat Transfer Powder | | Heat Transfer Liquid | | ΔT (°C) |
|---|---|---|---|---|---|
| | Material | Particle Size (mm) | Type | Addition Amount (vol%) | |
| EXAMPLE 1 | Cu | 0.003 | Pentadecane | 36 | 3.5 |
| EXAMPLE 2 | Cu | 0.07 | Pentadecane | 36 | 4.3 |
| EXAMPLE 3 | Cu | 0.1 | Pentadecane | 37 | 4.8 |
| EXAMPLE 4 | Cu | 0.2 | Pentadecane | 36 | 3.5 |
| EXAMPLE 5 | Cu | 0.3 | Pentadecane | 35 | 3.4 |
| EXAMPLE 6 | Cu | 0.053 – 0.15 | Pentadecane | 36 | 5.1 |
| EXAMPLE 7 | Cu | 0.07 | Hexadecane | 36 | 4.7 |
| EXAMPLE 8 | Al | ≤ 0.15 | Pentadecane | 36 | 4.3 |
| EXAMPLE 9 | Sn | ≤ 0.15 | Pentadecane | 33 | 4.1 |
| EXAMPLE 10 | Zn | ≤0.053 | Pentadecane | 39 | 4.0 |
| EXAMPLE 11 | Cu | 0.07 | Pentadecane | 12 | 3.4 |
| EXAMPLE 12 | Cu | 0.07 | Pentadecane | 24 | 3.8 |
| EXAMPLE 13 | Cu | 0.07 | Pentadecane | 28 | 4.0 |
| EXAMPLE 14 | Cu | 0.07 | Pentadecane | 32 | 4.1 |
| EXAMPLE 15 | Cu | 0.07 | Pentadecane | 48 | 4.5 |
| EXAMPLE 16 | Cu | 0.07 | Pentadecane | 60 | 4.5 |
| COMPARATIVE EXAMPLE 1 | Cu | 0.07 | – | – | 2.7 |
| COMPARATIVE EXAMPLE 2 | – | – | Pentadecane | – | 3.1 |
| COMPARATIVE EXAMPLE 3 | Cu | 0.07 | Silicone Oil | 36 | 3.5 |
| COMPARATIVE EXAMPLE 4 | Cu | 0.3 | Silicone Oil | 35 | 3.2 |

FIG. 10

| Tilt Angle (°) | ΔT (°C) | |
|---|---|---|
| | Side Surface Area A | Side Surface Area B |
| 30 | 8.1 | 6.7 |
| 45 | 8.2 | 6.8 |
| 60 | 6.7 | 5.7 |

FIG. 12

CONTAINER-CONTAINED BEVERAGE TEMPERATURE ADJUSTMENT APPARATUS AND HEAT TRANSFER MEMBER

CROSS REFERENCE TO RELATED APPLICATION

This is a continuation application of International Patent Application No. PCT/JP2019/018516 filed on May 9, 2019 claiming priority upon Japanese Patent Application No. 2018-094969 filed on May 16, 2018, of which full contents are incorporated herein by reference.

BACKGROUND

Technical Field

The present invention relates to a container-contained beverage temperature adjustment apparatus for adjusting the temperature of (e.g., for cooling, or maintaining cooled condition of) a beverage in a container (e.g., wine in a bottle), and a heat transfer member suitable for use in the container-contained beverage temperature adjustment apparatus.

Description of the Related Art

Conventionally, a bucket-like container filled with ice or ice water has been known as a wine cooler for cooling and maintaining a bottle-contained wine (hereinafter, referred to as "bottled wine") at a temperature suitable for drinking.

The above-described wine cooler, however, causes a direct contact between the bottle of the bottled wine and ice or the like, and therefore, when taking the bottled wine out of the wine cooler for pouring wine into a glass, there has been a necessity to take the trouble, for example, to wipe away water droplets clinging to the bottle.

In view of the necessity to remove water droplets clinging to a wine bottle in a conventional common wine cooler by wiping the bottle with a towel each time when taking the bottle out of the wine cooler for pouring wine into a glass, Japanese Patent Application Laid-Open Publication No. 2010-47313 discloses a wine cooler including a cold storage container having cylindrical and bottom parts with an open top and refrigerant members attached to the inner wall of the cold storage container with fixing means, as a wine cooler of simple structure which can reduce adherence of water droplets to the wine bottle and can provide visual recognition of a label on the wine bottle.

BRIEF SUMMARY

Problems to be Solved

The objective of the present invention is to provide a container-contained beverage temperature adjustment apparatus capable of adjusting the temperature of a container-contained beverage such as a bottled wine without the use of any ice or ice water, and a heat transfer member of high thermal conductivity suitable for use in the container-contained beverage temperature adjustment apparatus.

Means for Solving Problems

A container-contained beverage temperature adjustment apparatus, according to an aspect of the present invention, comprises: a heat transfer member capable of abutting a part of a side surface of a container-contained beverage as an object of temperature adjustment; and a temperature adjustment unit configured to adjust a temperature of the container-contained beverage through the heat transfer member, wherein the heat transfer member comprises a deformable bag body, and heat transfer powder and heat transfer liquid contained in the bag body, and wherein the heat transfer liquid is a liquid which freezes at a temperature higher than a target temperature.

In this aspect, the container-contained beverage temperature adjustment apparatus may further comprise: a biasing portion for causing the container-contained beverage and the heat transfer member to abut each other.

Further, in the foregoing aspects, the heat transfer member may be to abut an upper part of the container-contained beverage. Further, the heat transfer member may be to abut the container-contained beverage over an entire range of upper to lower parts thereof, and alternatively, may comprise a plurality of heat transfer members, each of which comprises the heat transfer member, wherein the plurality of heat transfer members are arranged at intervals in a longitudinal direction of the container-contained beverage. In this aspect, the container-contained beverage temperature adjustment apparatus may further comprise: a second heat transfer member disposed between the heat transfer member(s) and the temperature adjustment unit. Still further, in this aspect, the second heat transfer member may comprise a metal plate.

Further, in the foregoing aspects, after the heat transfer liquid has frozen, the heat transfer liquid may be maintained in a frozen state while the temperature of the container-contained beverage is being adjusted.

Further, in the foregoing aspects, before an adjustment of the temperature of the container-contained beverage is started, the heat transfer member may be heated by the temperature adjustment unit so that the heat transfer liquid in a frozen state melts.

Further, in the foregoing aspects, the heat transfer powder may comprise metal powder. Further, the heat transfer liquid may comprise any one of: straight-chain hydrocarbon; primary alcohol; straight-chain aldehyde; and straight-chain carboxylic acid.

Further, in the foregoing aspects, an addition amount of the heat transfer liquid relative to the heat transfer powder may be greater than or equal to 24 vol %, and alternatively, may be within a range of approximately 28 to 48 vol %.

Further, in the foregoing aspects, the heat transfer powder may have a particle size within a range of 0.04 to 0.16 mm.

A heat transfer member, according to an aspect of the present invention, is a heat transfer member to be used for adjusting a temperature of an object of temperature adjustment to a target temperature, the heat transfer member comprising: a deformable bag body; and heat transfer powder and heat transfer liquid contained in the bag body, wherein the heat transfer liquid is a liquid which freezes at a temperature higher than the target temperature.

In this aspect, the heat transfer powder may comprise metal powder. Further, the heat transfer liquid may comprise any one of: straight-chain hydrocarbon; primary alcohol; straight-chain aldehyde; and straight-chain carboxylic acid.

Further, in the foregoing aspects, an addition amount of the heat transfer liquid relative to the heat transfer powder may be greater than or equal to 24 vol %, and alternatively, may be within a range of approximately 28 to 48 vol %.

Further, in the foregoing aspects, the heat transfer powder may have a particle size within a range of 0.04 to 0.16 mm.

Advantageous Effects of the Invention

According to the present invention, it is possible to provide a container-contained beverage temperature adjustment apparatus capable of adjusting the temperature of a container-contained beverage such as a bottled wine without the use of any ice or ice water, and a heat transfer member of high thermal conductivity suitable for use in the container-contained beverage temperature adjustment apparatus.

BRIEF DESCRIPTION OF THE DRAWINGS

FIG. 10 is a table showing a measurement result of each heat transfer pad.

FIG. 12 is a table showing a measurement result obtained in a state where the bottled wine is tilted to a predetermined angle.

DETAILED DESCRIPTION

Hereinafter, embodiments according to the present invention will be described with reference to the drawings.

Hereinafter, a wine temperature adjustment apparatus will be explained as a container-contained beverage temperature adjustment apparatus according to the present invention. The wine temperature adjustment apparatus is an apparatus for adjusting the temperature of a bottled wine to a predetermined temperature suitable for drinking (target temperature). The wine temperature adjustment apparatus is to be used for, e.g., cooling a bottled wine in a state at a room temperature to a target temperature, and maintaining the bottled wine at the target temperature. Hereinafter, for simplicity, it is assumed that the target temperature is predetermined. However, the target temperature may be set by a user (e.g., selected from a plurality of predetermined choices).

First Embodiment

Figure 1A:
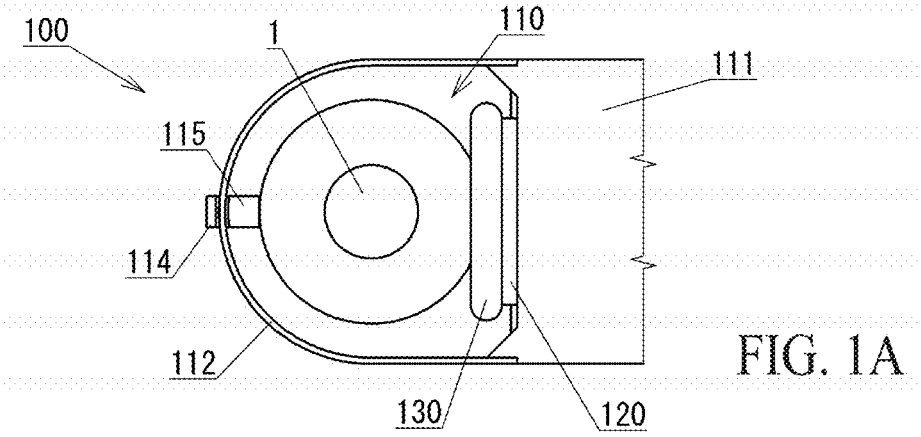
FIGS. 1A and 1B are views for explaining the configuration of a wine temperature adjustment apparatus according to the present invention.
Figure 1B:
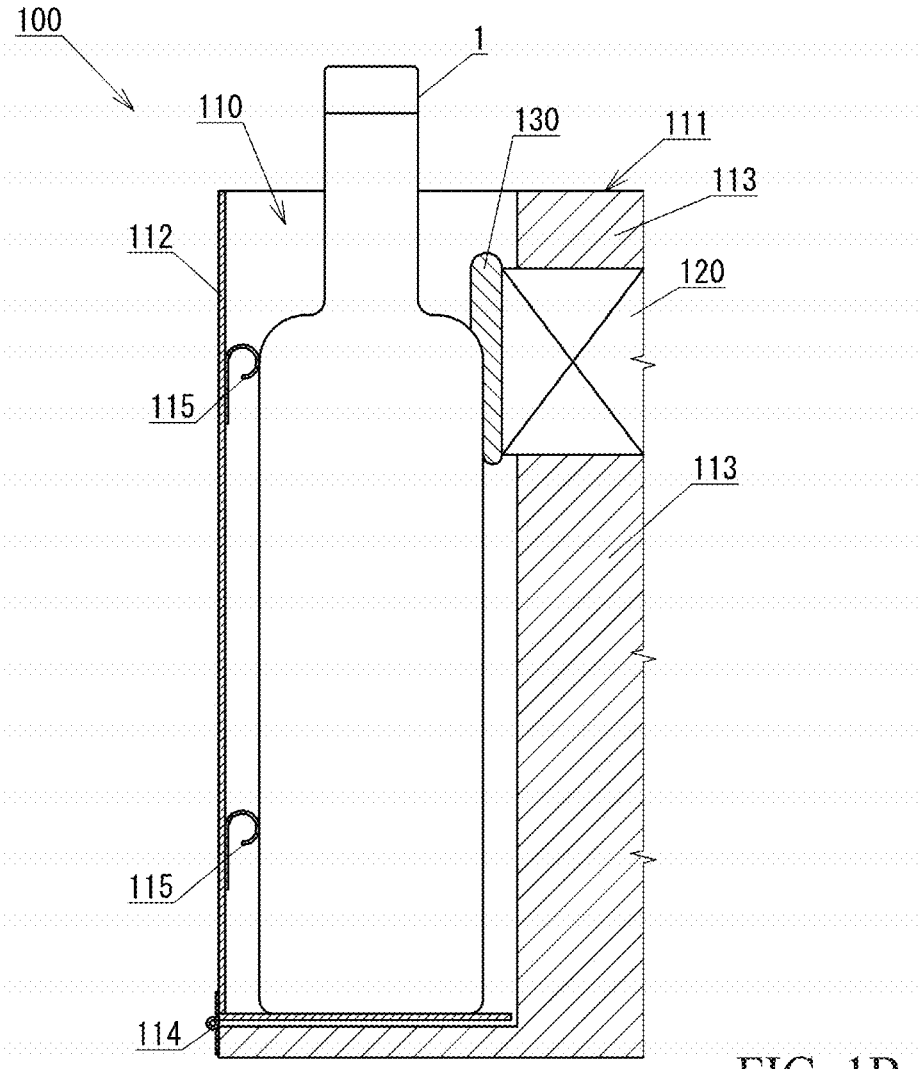

FIGS. 1A and 1B are views for explaining the configuration of a wine temperature adjustment apparatus according to the present invention. FIG. 1A shows a plan view, and FIG. 1B shows a horizontal cross-sectional view taken centrally in the plan view. For simplicity, only principal parts necessary for explaining the present invention are shown in FIGS. 1A and 1B.

As shown in FIGS. 1A and 1B, a wine temperature adjustment apparatus 100 according to the present invention includes a bottle-accommodating portion 110 for accommodating a bottled wine 1 as an object of temperature adjustment, a Peltier unit 120 for adjusting the temperature of the bottled wine 1 accommodated in the bottle-accommodating portion 110, and a heat transfer pad 130 disposed between the bottled wine 1 accommodated in the bottle-accommodating portion 110 and the Peltier unit 120.

The bottle-accommodating portion 110 is a space for accommodating the bottled wine 1 as the object of temperature adjustment. In this embodiment, the bottle-accommodating portion 110 is defined by a main body 111 and an openable/closable cover 112.

The main body 111 is a principal part of the wine temperature adjustment apparatus 100. As shown in FIG. 1B, the main body 111 includes the Peltier unit 120 therein, and the space around the Peltier unit 120 is filled with a heat insulator 113.

The cover 112 is attached to the main body 111 through a hinge mechanism 114 provided at a lower end part of the cover 112, and is configured such that the cover 112 is pivotally rotatable about an axis of the hinge mechanism 114.

As shown in FIGS. 1A and 1B, flat springs 115 are provided inside the cover 112.

The flat spring 115 serves as a biasing portion together with the cover 112 for causing the bottled wine 1 and the heat transfer pad 130 to abut each other, and is a biasing member for biasing the bottled wine 1 accommodated in the bottle-accommodating portion 110 in a direction toward the Peltier unit 120 (heat transfer pad 130).

The Peltier unit 120 is a unit (temperature adjustment unit) for adjusting the temperature of (cooling, and maintaining the cooled condition of) the bottled wine 1 accommodated in the bottle-accommodating portion 110, and in this embodiment, configured to adjust the temperature of the bottled wine 1 through the heat transfer pad 130. For simplicity, the Peltier unit 120 is illustrated in a simplified form in FIGS. 1A and 1B. A detailed structure of the Peltier unit 120 will be described later.

While not shown in FIGS. 1A and 1B for simplicity, the wine temperature adjustment apparatus 100 further includes: a controller for controlling the operation of the Peltier unit 120; a fan for air-cooling the Peltier unit 120 (radiating fin); a power supply unit for supplying power necessary for the operation of the Peltier unit 120, etc.; an operation portion to be used by a user for giving instructions as to various types of operations of the wine temperature adjustment apparatus 100; a temperature detection portion for detecting a temperature such as the temperature of the bottled wine 1; a display portion for displaying various types of information; or the like.

The heat transfer pad 130 is a member (heat transfer member) for abutting the bottled wine 1 (a part of a side surface of the bottled wine 1) accommodated in the bottle-accommodating portion 110 so as to conduct heat between the bottled wine 1 and the Peltier unit 120. In this embodiment, the heat transfer pad 130 abuts the bottled wine 1 at a position in the vicinity of the shoulder (an upper part of the side surface) of the bottle. The heat transfer pad 130 has a generally rectangular plate shape and is suspended, with an attachment tool not shown, to be parallel to a temperature adjustment surface of the Peltier unit 120. More specifically, the heat transfer pad 130 is not fixed to the temperature adjustment surface of the Peltier unit 120 and brought into intimate contact with the temperature adjustment surface of the Peltier unit 120 by the bottled wine 1 being pressed against the heat transfer pad 130.

The heat transfer pad 130 includes a deformable container bag, and heat transfer powder and heat transfer liquid contained in the container bag.

The container bag is a bag body for containing the heat transfer powder and the heat transfer liquid, and is made of material having appropriate strength and flexibility (in this embodiment, synthetic resin (more specifically, polyethylene)).

The heat transfer powder serves as a principal heat transfer medium together with the heat transfer liquid. The heat transfer powder is metal powder of high thermal conductivity and, in this embodiment, comprises copper (Cu) powder.

The heat transfer liquid serves as a principal heat transfer medium together with the heat transfer powder. The heat transfer liquid is a liquid which freezes at a temperature higher than a target temperature (e.g., 8° C.), and, in this embodiment, comprises paraffin. More specifically, the heat transfer liquid comprises pentadecane ($C_{15}H_{32}$) (freezing point: 9.9° C.) or hexadecane ($C_{16}H_{34}$) (freezing point: 18° C.). Therefore, in this embodiment, the heat transfer liquid freezes at a temperature between a target temperature (e.g., 8° C.) and an ambient temperature at the time of the use (e.g., 25° C.) (i.e., a temperature higher than the target temperature and lower than the ambient temperature at the time of the use), and is not frozen at the ambient temperature at the time of the use (e.g., 25° C.).

The addition amount of the heat transfer liquid relative to the heat transfer powder is set at a value at which the heat transfer liquid and the heat transfer powder exist substantially in a capillary state (a state in which all of the gaps between the heat transfer powder particles are filled with the heat transfer liquid), and more specifically, a value within a range of approximately 35 to 37 vol %.

Figure 2B:
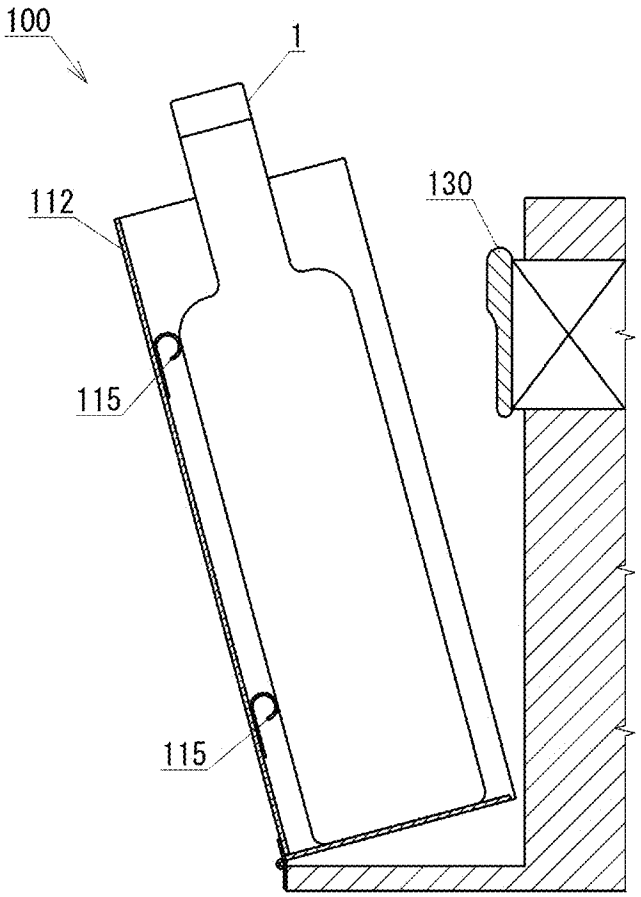
FIGS. 2A and 2B are views showing a wine temperature adjustment apparatus 100 with a cover 112 in an opened state.
Figure 2A:
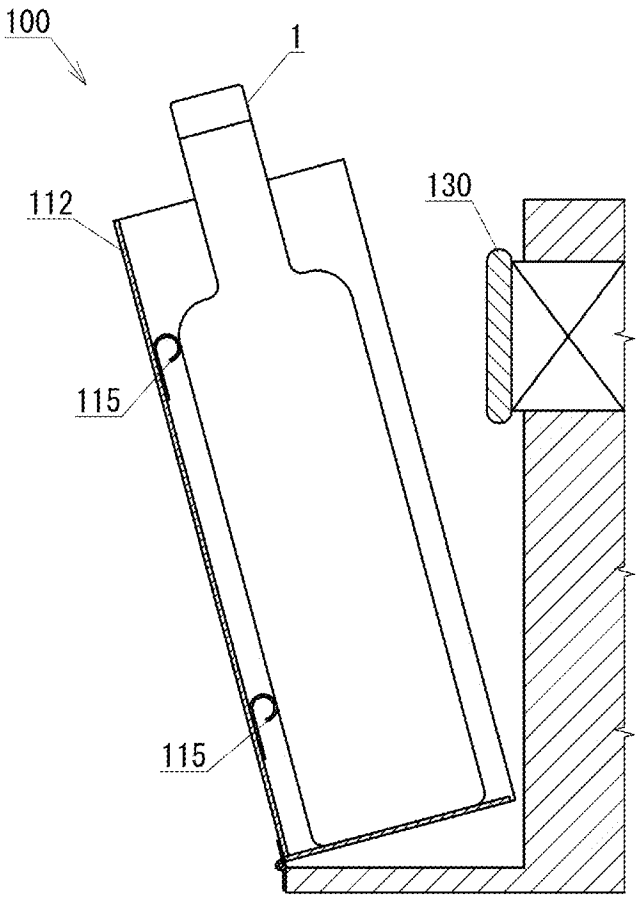

FIGS. 2A and 2B are views showing the wine temperature adjustment apparatus 100 with the cover 112 in an opened state. FIG. 2A shows a state in which the cover 112 is opened for setting the bottled wine 1 before cooling is started. FIG. 2B shows a state in which the cover 112 is opened for taking out the bottled wine 1 after being cooled to the target temperature.

To use the wine temperature adjustment apparatus 100, initially, the cover 112 is opened and a bottled wine 1 as an object of temperature adjustment is set as shown in FIG. 2A, and subsequently, the cover 112 is closed as shown in FIGS. 1A and 1B, and then cooling is started.

Upon closure of the cover 112 subsequent to the setting of the bottled wine 1, the bottled wine 1 is biased by the flat springs 115 to be pressed against the heat transfer pad 130.

As a result of being pressed against by the bottled wine 1, the heat transfer pad 130 is deformed appropriately to fit to the shape of the bottled wine 1 and come into tight contact with the bottled wine 1, and thereby the efficiency of thermal conductivity is improved.

In the wine temperature adjustment apparatus 100, since the heat transfer pad 130 is allowed to fit to the shape of the bottled wine 1 by pressing the bottled wine 1 (a part of the side surface of the bottled wine 1) against the deformable heat transfer pad 130, even in the presence of a certain difference in shape or size among pieces of the bottled wine 1, tight contact can be accomplished between the bottled wine 1 and the heat transfer pad 130.

Further, as described above, the heat transfer liquid contained in the heat transfer pad 130 freezes at a temperature higher than the target temperature, and therefore, the heat transfer liquid freezes at some point while being cooled to the target temperature. As shown in FIG. 2B, therefore, when the cover 112 is opened after being cooled to the target temperature, the shape of the heat transfer pad 130 is maintained in a state that the shape is deformed to fit to the shape of the bottled wine 1. As a result, for example, even when the bottled wine 1 is taken out from the wine temperature adjustment apparatus 100 for pouring wine into a glass and thereafter the same bottled wine 1 is set again in the wine temperature adjustment apparatus 100, a tight contact state between the bottled wine 1 and the heat transfer pad 130 is maintained.

When the cooling of a new bottled wine 1 is to be started in the wine temperature adjustment apparatus 100, for example, in response to the instructions provided by a user through the operation portion, initially, the Peltier unit 120 is controlled by the controller to heat the heat transfer pad 130 so that the heat transfer liquid in a frozen state melts, and thereafter a new bottled wine 1 is allowed to be set. In such a manner, when the new bottled wine 1 is set, it is possible for the heat transfer pad 130 to be deformed newly to fit to the shape of the new bottled wine 1.

Next, the Peltier unit 120 will be described in detail.

Figure 3:
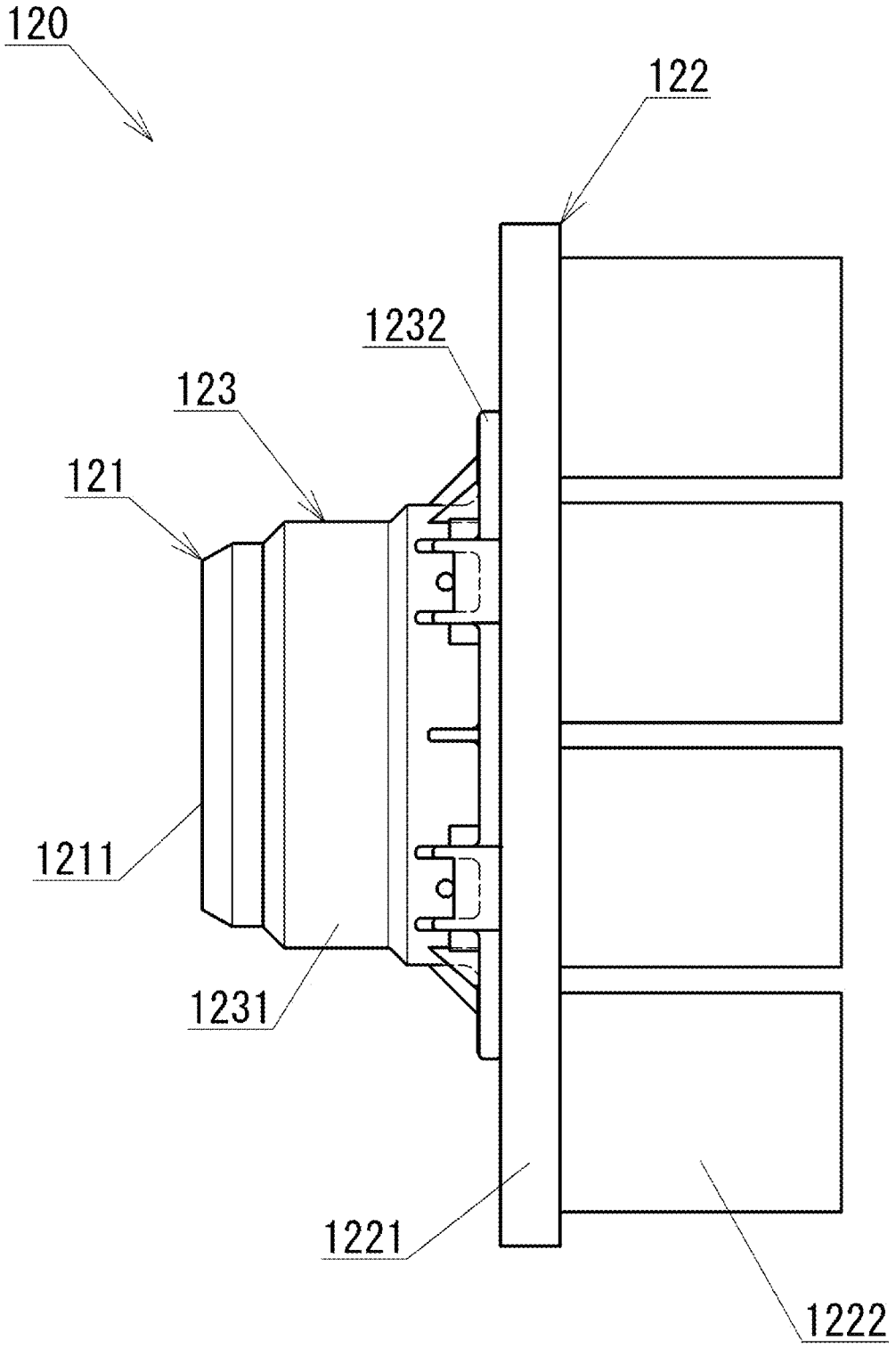
FIG. 3 is a front view for explaining the structure of a Peltier unit 120.
Figure 4:
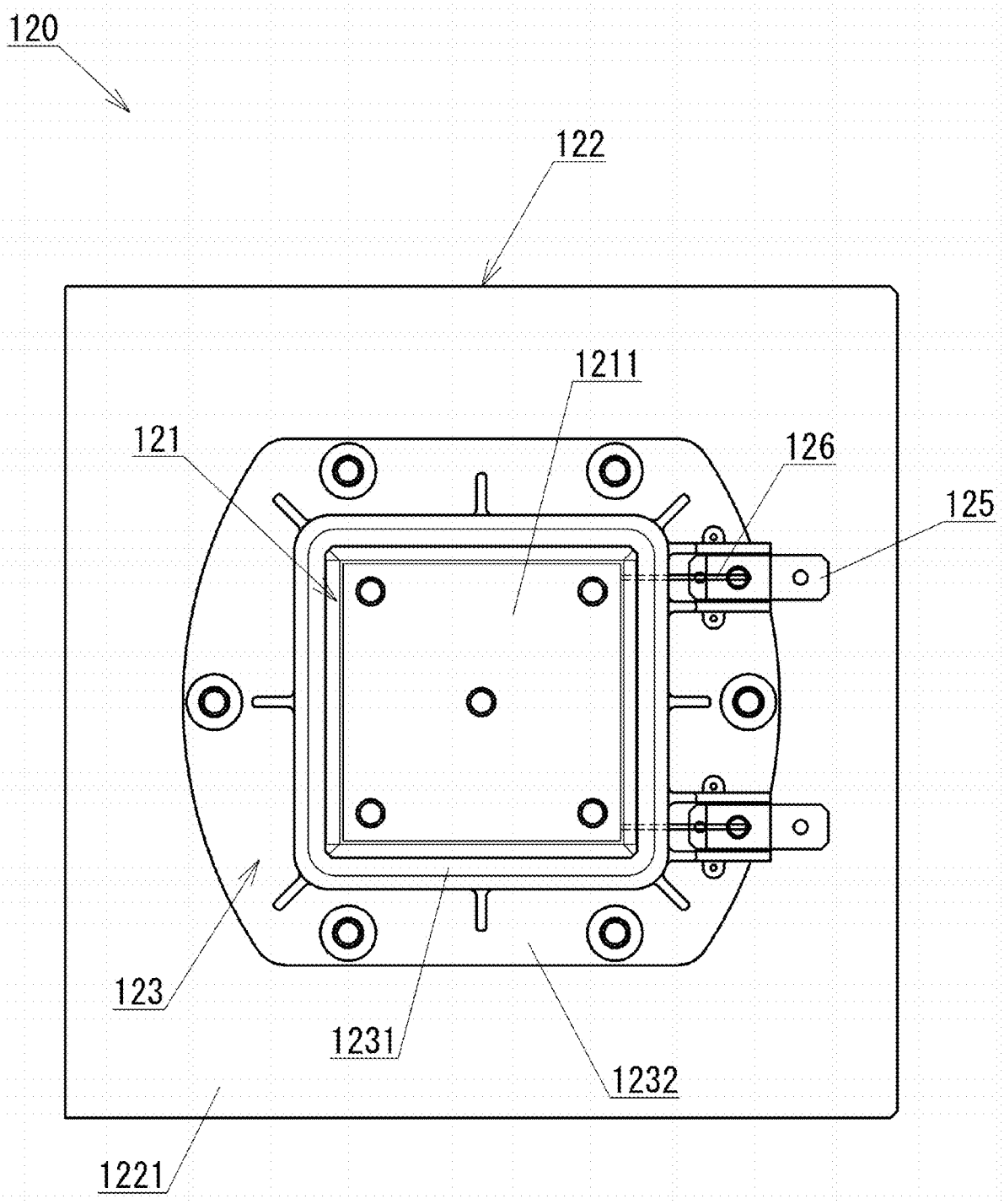
FIG. 4 is a left side view for explaining the structure of the Peltier unit 120.
Figure 5:
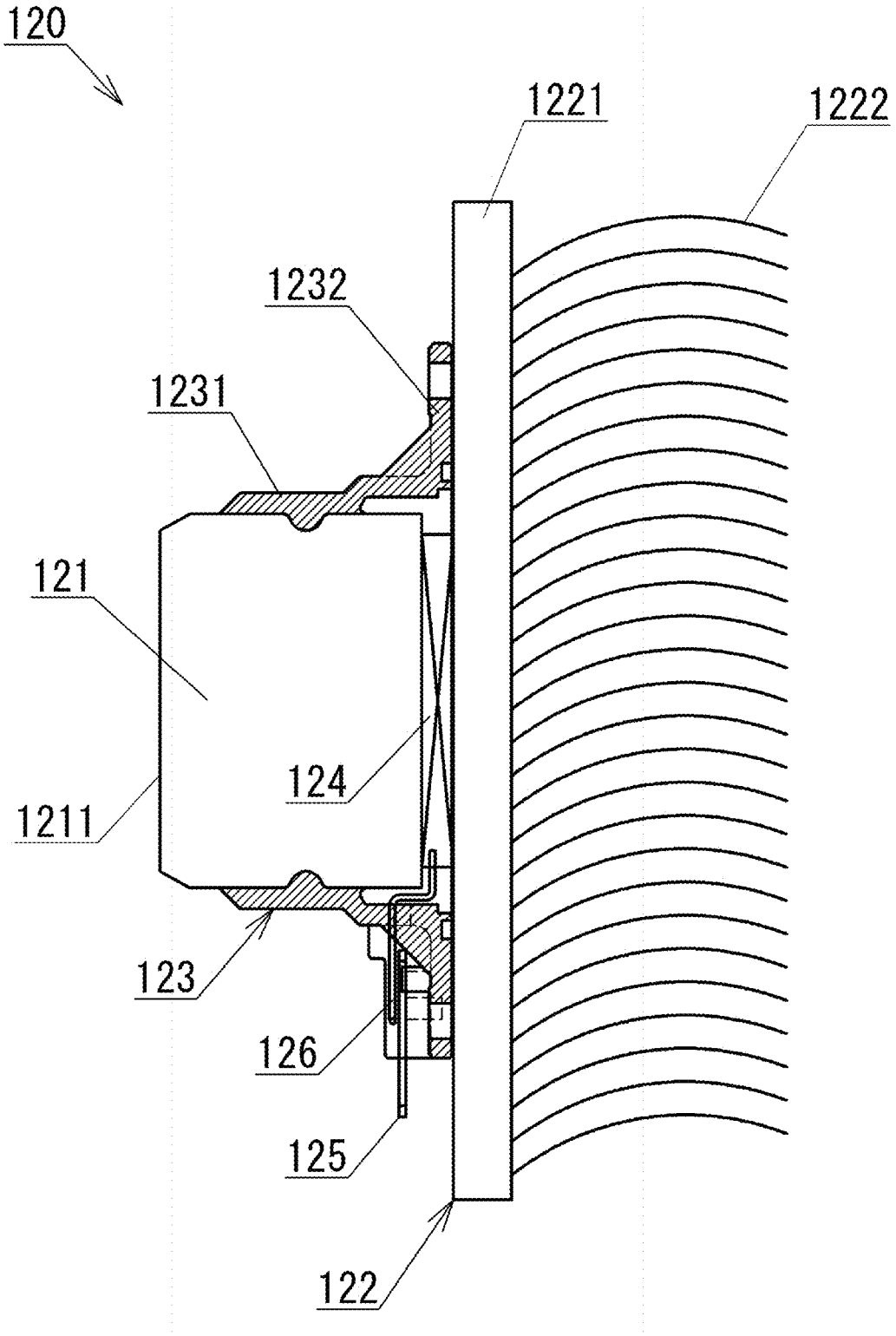
FIG. 5 is a horizontal cross-sectional view taken centrally in the front view for explaining the structure of the Peltier unit 120.

FIGS. 3 to 5 are views for explaining the structure of the Peltier unit 120. FIG. 3 shows a front view, and FIG. 4 shows a left side view, and FIG. 5 shows a horizontal cross-sectional view taken centrally in the front view.

As shown in FIGS. 3 to 5, the Peltier unit 120 includes a heat transfer block 121, radiating fin 122, and casing 123. Further, as shown in FIG. 5, the Peltier unit 120 has a thermoelectric conversion module 124 interposed between the heat transfer block 121 and the radiating fin 122.

The heat transfer block 121 is a heat transfer member contacting one surface of the thermoelectric conversion module 124 for transferring heat. The heat transfer block 121 is made of, for example, a metal of high thermal conductivity (e.g., aluminum). The heat transfer block 121 has a generally rectangular column shape, and its upper surface (temperature adjustment surface) 1211 is to be abutted by the heat transfer pad 130.

The radiating fin 122 is a heat transfer member (heat radiating member) contacting the other surface of the thermoelectric conversion module 124 for transferring (radiating) heat. The radiating fin 122 is made of, for example, a metal of high thermal conductivity (e.g., aluminum). The radiating fin 122 includes a rectangular plate 1221 and many fins 1222 attached to its bottom surface, and is to be air-cooled forcedly by a fan (not shown).

The casing 123 surrounds a peripheral (lateral-side) portion of the thermoelectric conversion module 124 interposed between the heat transfer block 121 and radiating fin 122 with a gap to form an enclosed space around the thermoelectric conversion module 124, and is made of, for example, a synthetic resin having low thermal conductivity, resistance to water, and low gas permeability (e.g., polyphenylene sulfide). The casing 123 includes: a side wall portion 1231 extending along a side surface of the heat transfer block 121 to mostly cover the side surface of the heat transfer block 121; and a projecting portion 1232 extending outwardly along an upper surface of the radiating fin 122 to partially cover the upper surface of the radiating fin 122 (rectangular plate 1221), and is formed to be generally L-shaped in cross section. The casing 123 is formed, for example, by insert-molding to be integral with the heat transfer block 121, and the projecting portion 1232 is to be fixed (screw-fastened) to the radiating fin 122.

As shown in FIG. 4, the projecting portion 1232 of the casing 123 has a side provided with a pair of tab terminals 125 through which direct current is supplied to the thermoelectric conversion module 124. The tab terminals 125 and the thermoelectric conversion module 124 (metal electrodes thereof) are connected by lead wires 126.

Figure 6:
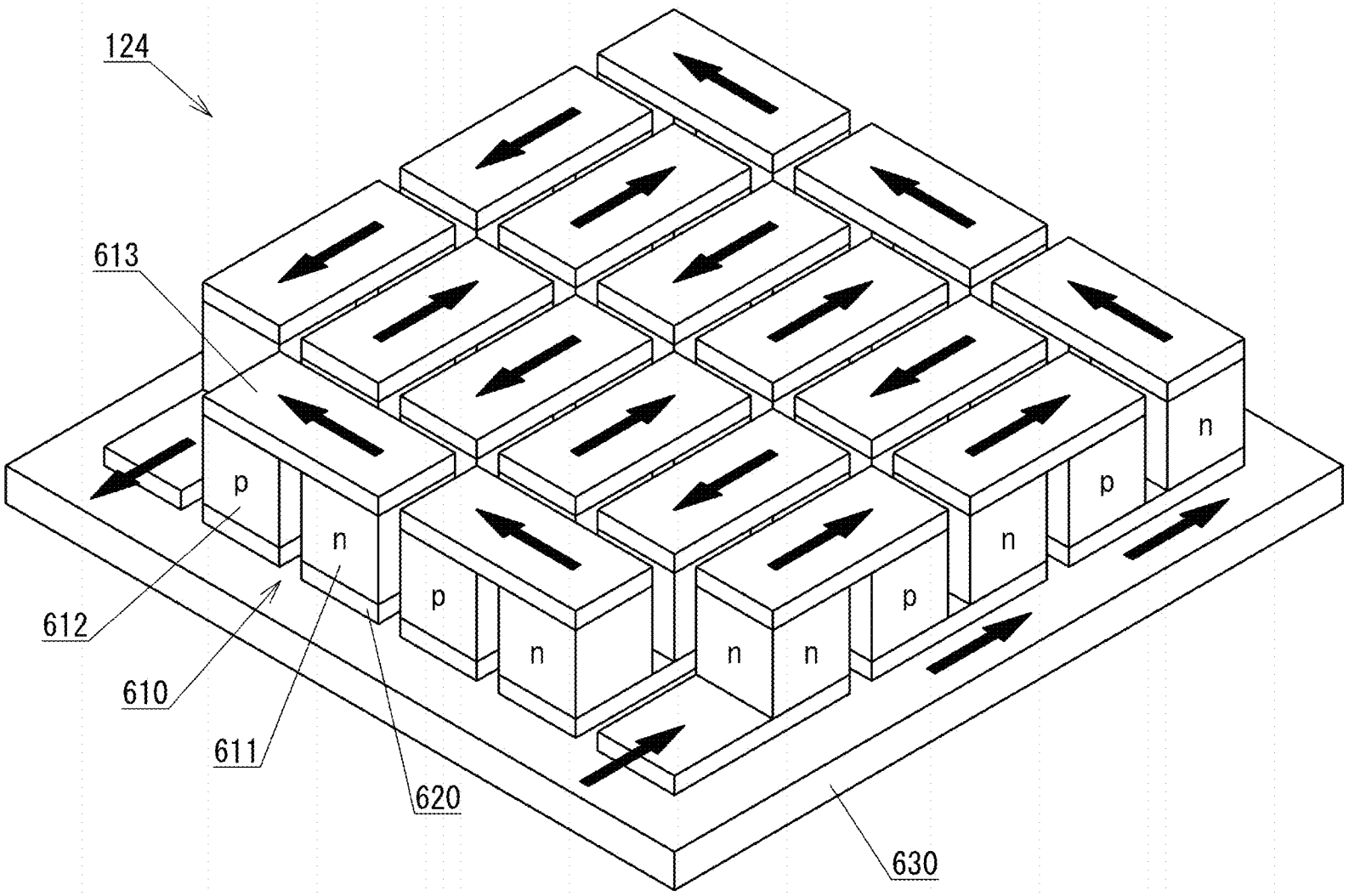
FIG. 6 is a view for explaining the structure of a thermoelectric conversion module 124.

FIG. 6 is a view for explaining the structure of the thermoelectric conversion module 124.

As shown in FIG. 6, the thermoelectric conversion module 124 includes a plurality of π-shaped thermoelectric elements 610 arranged in a plate-like manner, each of which is obtained as a result of joining an n-type semiconductor element 611 and a p-type semiconductor element 612 by a metal electrode 613 at their respective ends. Through metal electrodes 620, the plurality of π-shaped thermoelectric elements 610 are electrically connected in series, and thermally connected in parallel. In the example shown in FIG. 6, when direct current is allowed to flow in a direction indicated by the arrow (direction from n-side to p-side of the π-shaped thermoelectric element), heat is absorbed on the upper-surface side (np-junction side of the π-shaped thermoelectric element), and heat is dissipated on the bottom-surface side. When direct current is allowed to flow in the opposite direction, heat is dissipated on the upper-surface side, and heat is absorbed on the bottom-surface side. Further, in general, insulating substrates 630 (e.g., ceramic substrates) are joined to both the upper surface and the bottom surface, respectively, to form a heat-absorbing surface and a heat radiating surface. The insulating substrate on the upper-surface side is omitted in FIG. 6.

According to the above-described configuration of the Peltier unit 120, it is possible to adjust the temperature of the heat transfer pad 130 (and the bottled wine 1) by controlling an amount and direction of electric current supplied to the Peltier unit 120 (thermoelectric conversion module 124).

Second Embodiment

Next, another wine temperature adjustment apparatus (second embodiment) according to the present invention will be explained.

Hereinafter, the descriptions will be basically presented only for differences from the above-described first embodiment. The elements similar to those of the first embodiment will be accompanied with the same reference numerals, and detailed explanations thereof will be omitted.

Figure 7A:
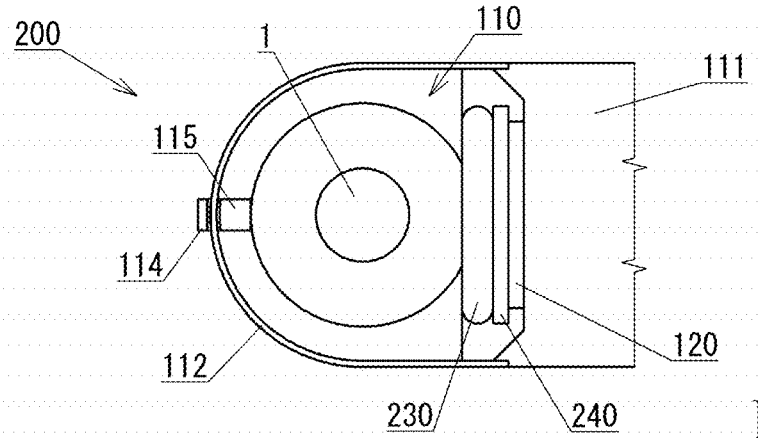
FIGS. 7A and 7B are views for explaining the configuration of another wine temperature adjustment apparatus (second embodiment) according to the present invention.
Figure 7B:
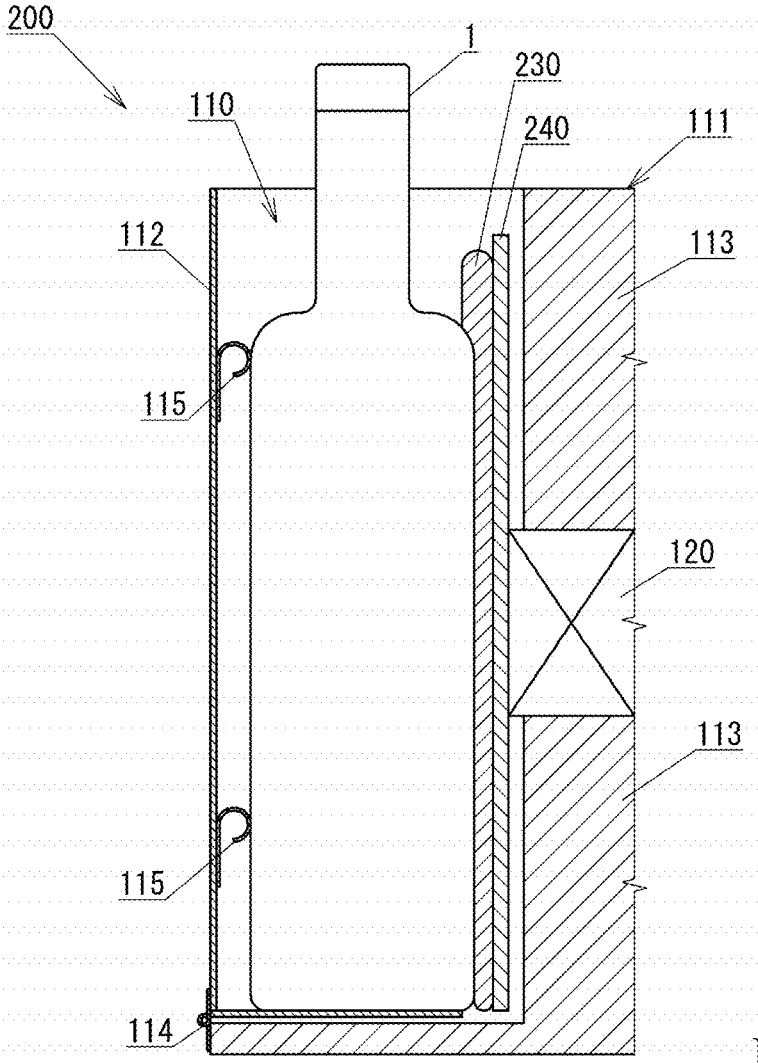

FIGS. 7A and 7B are views for explaining the configuration of another wine temperature adjustment apparatus (second embodiment) according to the present invention. FIG. 7A shows a plan view, and FIG. 7B shows a horizontal cross-sectional view taken centrally in the plan view.

As shown in FIGS. 7A and 7B, a second wine temperature adjustment apparatus 200 according to the present invention includes a bottle-accommodating portion 110 for accommodating a bottled wine 1 as an object of temperature adjustment, a Peltier unit 120 for cooling the bottled wine 1 accommodated in the bottle-accommodating portion 110, and a heat transfer pad 230 and a heat transfer plate 240 disposed between the bottled wine 1 accommodated in the bottle-accommodating portion 110 and the Peltier unit 120.

In this embodiment, the Peltier unit 120 is configured to adjust the temperature of the bottled wine 1 through the heat transfer plate 240 and the heat transfer pad 230.

The heat transfer plate 240 is a member (heat transfer member) disposed between the Peltier unit 120 and the heat transfer pad 230 for conducting heat between the Peltier unit 120 and the heat transfer pad 230, and, in this embodiment, the heat transfer plate 240 comprises a thin (e.g., 5 mm in thickness) metal plate (more specifically, a copper plate). The heat transfer plate 240 is fixed (screw-fastened) to the heat transfer block 121 of the Peltier unit 120.

The heat transfer pad 230 is a member (heat transfer member) for abutting the bottled wine 1 (a part of a side surface of the bottled wine 1) accommodated in the bottle-accommodating portion 110 so as to conduct heat between the bottled wine 1 and the heat transfer plate 240. The heat transfer pad 230 includes the same elements (container bag, heat transfer powder and heat transfer liquid) as the heat transfer pad 130 of the first embodiment, and differs from the heat transfer pad 130 only in shape and size. More specifically, the heat transfer pad 130 of the first embodiment abuts the bottled wine 1 at a position in the vicinity of the shoulder of the bottle; on the other hand, the heat transfer pad 230 of the second embodiment has generally a longitudinally-long rectangular plate shape, and abuts the bottled wine 1 over an entire range from the shoulder to the lower-end of the bottle. The heat transfer pad 230 is suspended, with an attachment tool not shown, to be parallel to the heat transfer plate 240. More specifically, the heat transfer pad 230 is not fixed to the heat transfer plate 240 and brought into intimate contact with the heat transfer plate 240 by the bottled wine 1 being pressed against the heat transfer pad 230.

According to the above-described configuration of the heat transfer pad 230 of the second embodiment, even for a bottled wine in a state of a small amount of wine inside the bottle (a state of a low liquid level), the temperature of the bottled wine can be adjusted efficiently. More specifically, as the wine inside the bottle continues to be drunk, the liquid level of wine decreases gradually. If the bottled wine in such a state is set in the wine temperature adjustment apparatus 100 of the first embodiment and if the liquid level of wine in the bottle is lower than a position at which the heat transfer pad 130 abuts the bottle, the efficiency in adjusting the temperature of the wine in the bottle (cooling efficiency) is reduced. On the other hand, in the wine temperature adjustment apparatus 200 of the second embodiment, since the heat transfer pad 230 abuts the bottle over an entire range from the shoulder to the lower-end of the bottle, a high efficiency in adjusting the temperature (cooling efficiency) can be achieved until the wine in the bottle is drunk to drain the bottle.

Third Embodiment

Next, still another wine temperature adjustment apparatus (third embodiment) according to the present invention will be described.

Hereinafter, the descriptions will be basically presented only for differences from the above-described first and second embodiments. The elements similar to those of the first and second embodiments will be accompanied with the same reference numerals, and detailed explanations thereof will be omitted.

Figure 8A:
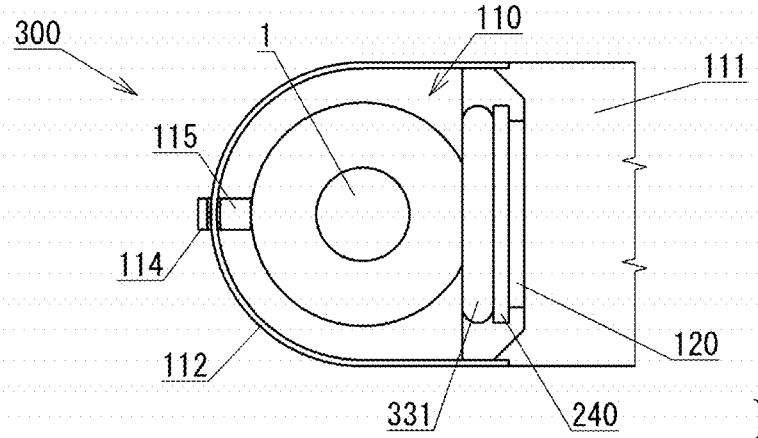
FIGS. 8A and 8B are views for explaining the configuration of a still another wine temperature adjustment apparatus (third embodiment) according to the present invention.
Figure 8B:
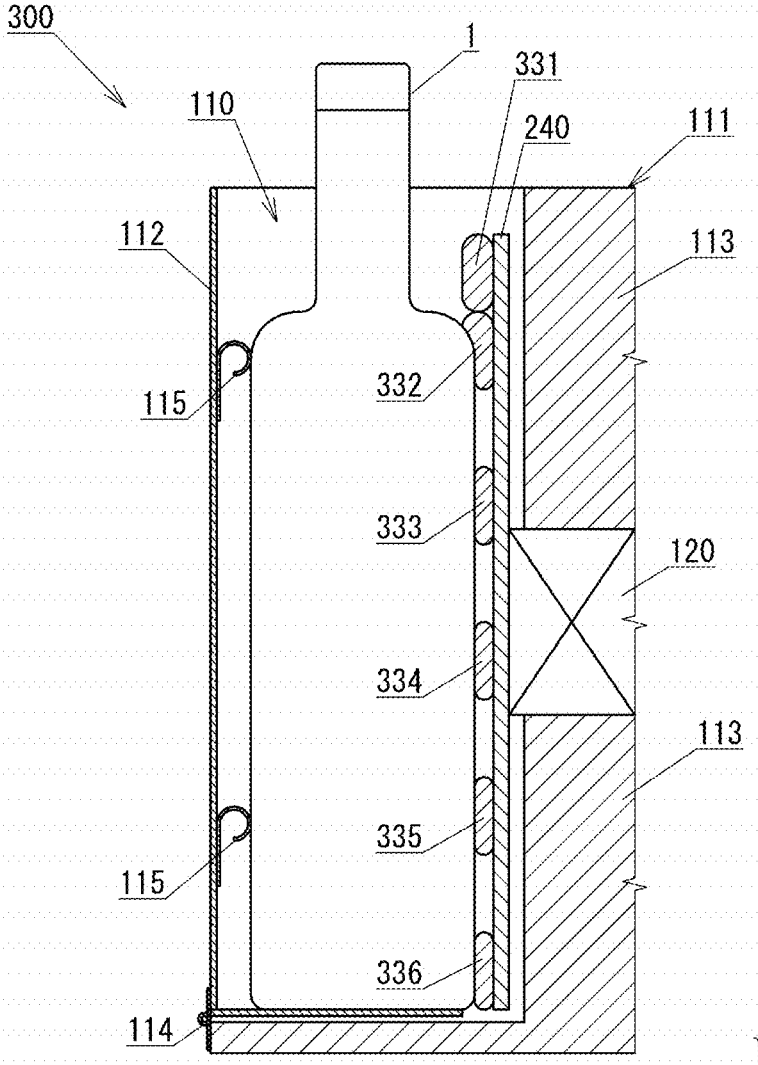

FIGS. 8A and 8B are views for explaining the configuration of still another wine temperature adjustment apparatus (third embodiment) according to the present invention. FIG. 8A shows a plan view, and FIG. 8B shows a horizontal cross-sectional view taken centrally in the plan view.

As shown in FIGS. 8A and 8B, a third wine temperature adjustment apparatus 300 according to the present invention has the configuration substantially similar to that of the above-described second wine temperature adjustment apparatus 200, and differs from the second wine temperature adjustment apparatus 200 only in a configuration of a heat transfer pad.

More specifically, the heat transfer pad of the second embodiment comprises a single large heat transfer pad 230; on the other hand, the heat transfer pad of the third embodiment comprises a plurality of small heat transfer pads 331 to 336.

The heat transfer pads 331 to 336 are members (heat transfer members) arranged at intervals in a perpendicular direction (a vertical direction in FIG. 8B), and capable of abutting the bottled wine 1 (a part of a side surface of the bottled wine 1) accommodated in the bottle-accommodating portion 110 so as to conduct heat between the bottled wine 1 and the heat transfer plate 240. Each of the heat transfer pads 331 to 336 includes the same elements (container bag, heat transfer powder and heat transfer liquid) as the heat transfer pad 230 of the second embodiment, and differs from the heat transfer pad 230 only in shape and size. More specifically, the heat transfer pad of the second embodiment covers a range from the shoulder to the lower-end of the bottle through the use of a single heat transfer pad 230; on the other hand, the heat transfer pad of the third embodiment covers a range from the shoulder to the lower-end of the bottle through the use of a plurality of heat transfer pads 331 to 336 arranged at intervals in a longitudinal direction of the bottled wine 1.

Each of the heat transfer pads 331 to 336 has a generally rectangular plate shape, and is suspended, with an attachment tool not shown, to be parallel to the heat transfer plate 240. More specifically, each of the heat transfer pads 331 to 336 is not fixed to the heat transfer plate 240 and brought into intimate contact with the heat transfer plate 240 by the bottled wine 1 being pressed against each of the heat transfer pads 331 to 336.

According to the above-described configuration of the heat transfer pad of the third embodiment, even for bottled wine in a state of a small amount of wine inside the bottle (a state of a low liquid level), the temperature can be adjusted efficiently in a similar manner to the second embodiment, and a high efficiency in adjusting the temperature (cooling efficiency) can be achieved until the wine in the bottle is drunk to drain the bottle.

In FIGS. 8A and 8B, the heat transfer pad 331 at the highest position, which does not abut the side surface of the bottled wine 1, is provided for a bottled wine which is taller than (which has higher shoulder position than) the bottled wine 1 shown in FIGS. 8A and 8B.

Next, a control system for controlling the operation of the above-described wine temperature adjustment apparatus will be explained.

Figure 9:
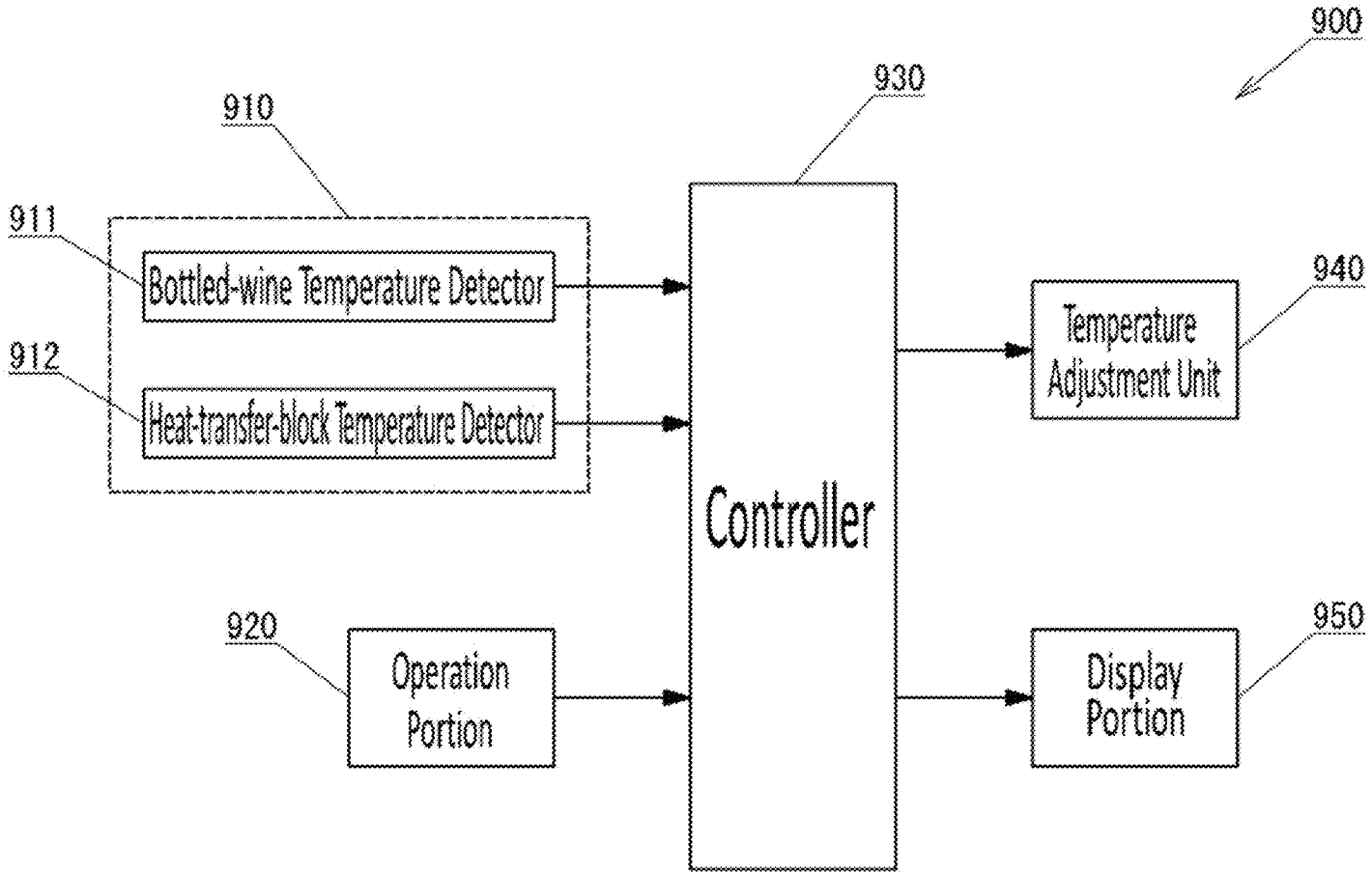
FIG. 9 is a view for explaining an exemplary configuration of a control system for controlling the operation of the wine temperature adjustment apparatus.

FIG. 9 is a view for explaining an exemplary configuration of the control system for controlling the operation of the above-described wine temperature adjustment apparatus.

As shown in FIG. 9, a control system 900 includes: a temperature detection portion 910; an operation portion 920; a controller 930; a temperature adjustment unit 940; and a display portion 950.

The temperature detection portion 910 is means for detecting a temperature at a predetermined position in the wine temperature adjustment apparatus, and in the present embodiments, the temperature detection portion 910 includes a bottled-wine temperature detector 911 and a heat-transfer-block temperature detector 912.

The bottled-wine temperature detector 911 is a detector (container-contained-beverage temperature detector) configured to detect the temperature of the bottled wine 1 (container-contained beverage), and comprises a temperature sensor such as a thermistor. The bottled-wine temperature detector 911 is configured, for example, such that it abuts a lower side surface of the bottled wine 1 when the bottled wine 1 is set in the wine temperature adjustment apparatus. The bottled-wine temperature detector 911 is electrically connected to the controller 930, and is configured in such a manner that a signal corresponding to a temperature detected by the bottled-wine temperature detector 911 is input to the controller 930.

The heat-transfer-block temperature detector 912 is a detector (temperature-adjustment-unit temperature detector) configured to detect the temperature of the heat transfer block 121 of the Peltier unit 120, and comprises a temperature sensor such as a thermistor. The heat-transfer-block temperature detector 912 is electrically connected to the controller 930, and is configured in such a manner that a signal corresponding to a temperature detected by the heat-transfer-block temperature detector 912 is input to the controller 930.

The operation portion 920 is to be used by a user for providing instructions as to various types of operations of the wine temperature adjustment apparatus, and comprises, e.g., a switch. The operation portion 920 is electrically connected to the controller 930, and is configured in such a manner that a signal corresponding to instructions provided by the user is input to the controller 930.

The controller 930 is a unit configured to control the operation of the temperature adjustment unit 940 on the basis of inputs from the temperature detection portion 910 and the operation portion 920, and comprises, e.g., a microcontroller.

The temperature adjustment unit 940 is a unit configured to adjust the temperatures of the heat transfer pad and the bottled wine 1, and in the present embodiments, the temperature adjustment unit 940 comprises the Peltier unit 120. The temperature adjustment unit 940 is electrically connected to the controller 930, and is configured in such a manner that an amount and direction of electric current supplied to the Peltier unit 120 can be controlled in response to a signal output from the controller 930.

The display portion 950 is a portion for displaying various types of information, and comprises, e.g., a light-emitting diode (LED) or liquid crystal display (LCD). The display portion 950 is electrically connected to the controller 930, and is configured in such a manner that a display corresponding to a signal output from the controller 930 is presented.

Next, the operation of the control system 900 having the above-described configuration will be explained.

When the power to the wine temperature adjustment apparatus is turned on, the controller 930 initially controls the temperature adjustment unit 940 to start heating the heat transfer pad (warming operation). This is performed in preparation for a case where the heat transfer liquid which froze in the last-time use has not yet melted and is left in a frozen state. In the present embodiments, the warming operation is performed initially after the power is turned on to ensure that the heat transfer liquid in the heat transfer pad is not in a frozen state when the bottled wine 1 is set. During the warming operation, the temperature adjustment unit 940 is controlled in such a manner that a temperature detected by the heat-transfer-block temperature detector 912 is maintained at a predetermined temperature (warming temperature) at which the heat transfer liquid in the heat transfer pad can be melted. When a predetermined period of time (warming time) has elapsed after the temperature detected by the heat-transfer-block temperature detector 912 reaches the warming temperature, the controller 930 determines that the heat transfer liquid in the heat transfer pad is in a melted state, and stops the warming operation, and subsequently causes the display portion 950 to present a display indicative of the completion of cooling preparation (display of cooling-preparation completion).

Upon confirmation of the display of cooling-preparation completion through the display portion 950, the user sets a bottled wine 1 as an object of temperature adjustment in the wine temperature adjustment apparatus, and subsequently operates the operation portion 920 to provide instructions to start cooling the bottled wine 1. Upon receipt of instructions as to cooling-start, the controller 930 controls the temperature adjustment unit 940 to start cooling the heat transfer pad and the bottled wine 1 (cooling operation). During the cooling operation, the temperature adjustment unit 940 is controlled in such a manner that a temperature detected by the bottled-wine temperature detector 911 is maintained at a predetermined temperature (cooling temperature) corresponding to a target temperature. The cooling operation is continued, for example, until the power to the wine temperature adjustment apparatus is turned off. The heat transfer liquid in the heat transfer pad freezes while the temperature of the bottled wine 1 is reduced to the target temperature, and after having frozen, maintained in a frozen state during the cooling operation.

As explained above, in the above-described wine temperature adjustment apparatus, the temperature of the bottled wine as an object of temperature adjustment is adjusted through the Peltier unit and the heat transfer member (heat transfer pad and heat transfer plate), thereby enabling the adjustment of temperature of the bottled wine without the use of ice or ice water.

Further, a part of the side surface of a bottled wine as an object of temperature adjustment and the deformable heat transfer pad are caused to abut each other, thereby allowing the bottled wine and the heat transfer pad to tightly contact each other, and thereby enabling efficient adjustment of the temperature of the bottled wine.

The embodiments of the present invention have been explained above; however, it is obvious that the embodiments of the present invention are not limited to the above-described embodiments. For example, in the above-described embodiments, pentadecane or hexadecane is used as the heat transfer liquid. In accordance with a target temperature, etc., the followings can be considered to be applicable as the heat transfer liquid: other types of straight-chain hydrocarbon (e.g., heptadecane ($C_{17}H_{36}$) (freezing point: 22° C.), octadecane ($C_{14}H_{38}$) (freezing point: 27.1-28.5° C.), nonadecane ($C_{19}H_{40}$) (freezing point: 32-34° C.)); primary alcohol (e.g., 1-undecanol ($C_{11}H_{24}O$) (freezing point: 19° C.), 1-dodecanol ($C_{12}H_{26}O$) (freezing point: 24° C.), 1-tridecanol ($C_{13}H_{28}O$) (freezing point: 29-34° C.)); straight-chain aldehyde (e.g., dodecanal ($C_{12}H_{24}O$) (freezing point: 12° C.), tridecanal ($C_{13}H_{26}O$) (freezing point: 14° C.), tetradecanal ($C_{14}H_{28}O$) (freezing point: 23° C.), pentadecanal ($C_{15}H_{30}O$) (freezing point: 25° C.); and straight-chain carboxylic acid (e.g., octanoic acid ($C_8H_{16}O_2$) (freezing point: 16.7° C.), nonanoic acid ($C_9H_{18}O_2$) (freezing point: 11-13° C.), decanoic acid ($C_{10}H_{20}O_2$) (freezing point: 31° C.), undecanoic acid ($C_{11}H_{22}O_2$) (freezing point: 28-31° C.)). The upper limit of the freezing point of an applicable heat transfer liquid is generally less than or equal to an ambient temperature at the time of the use. In consideration of heating the heat transfer liquid to melt it before cooling is started through the use of the Peltier unit or the like, however, such an upper limit is less than or equal to the temperature at which the heat transfer liquid can be caused to melt through the use of the Peltier unit or the like.

Further, in the above-described embodiments, the cover 112 is configured such that it is pivotally rotatable about an axis of the hinge mechanism 114. Alternatively, it may be considered that the cover 112 is configured such that it is slidable in a horizontal direction (right-to/from-left direction in FIGS. 2A and 2B). By configuring the cover 112 to be slidable in a horizontal direction, the bottled wines 1 having a broader range in size (diameter) can be handled.

Further, in the above-described embodiments, the bottle-accommodating portion 110 is configured to accommodate the bottled wine 1 as an object of temperature adjustment in an upright position (standing position). Alternatively, it may be considered that the bottle-accommodating portion 110 is configured to accommodate the bottled wine 1 as an object of temperature adjustment in a tilted position (lying position), in which the bottled wine 1 is tilted to a predetermined angle.

Further, in the above-described embodiments, metal powder is used as the heat transfer powder. Alternatively, it may be considered to use powder made of different sorts of material (e.g., ceramic powder).

Further, the above-described embodiments are described in the case where they are used for adjustment of the temperature of a bottled wine. The present invention, however, may certainly be applicable to adjustment of the temperature of different sorts of container-contained beverage such as a canned wine.

Further, in the above-described embodiments, it is described that the heat transfer pad is used for the adjustment of the temperature of beverage. Alternatively, it may be considered to use the heat transfer pad according to the present invention for the adjustment of the temperature of a liquid other than the beverage or an object other than the container-contained beverage.

EXAMPLES

Next, examples of the heat transfer pad to be used in a container-contained beverage temperature adjustment apparatus according to the present invention will be explained.

A plurality of types of heat transfer pads, each of which contains heat transfer powder (copper powder) of a different particle size, were prepared as follows.

Example 1

75 g of a copper powder (available from DOWA Electronics Materials Co., Ltd.) having a manufacturer's indicated particle size of 3 μm (0.003 mm) was weighed out through the use of an electronic scale (KD-321, available from TANITA Cooperation), and transferred into a zipper poly bag (Unipac (registered trademark) GP B-4 available from SEISANNIPPONSHA LTD.) (hereinafter, referred to as "B-4 poly bag."). Subsequently, pentadecane ($C_{15}H_{32}$) (Wako special grade, available from Wako Pure Chemical Industries, Ltd.) was dropped in units of 0.5 ml through the use of a pipette (P1000, available from GILSON) while being fitted into the copper powder slowly until a liquid surface was visually recognizable on the surface of the copper powder. Subsequently, 0.5 ml of the pentadecane was further added. Air bubbles in the prepared heat transfer pad were removed sufficiently by methods including applying vibration. In a state where the air is removed from the bag as much as possible, the bag was sealed to form a final heat transfer pad.

The poured amount of pentadecane was 8 ml in total. The bulk volume of 75 g of the copper powder was measured through the use of a 50 ml measuring cylinder and found to be 22.5 ml. In this case, therefore, the addition amount of the heat transfer liquid (pentadecane) relative to the heat transfer powder (copper powder) was at a volume ratio (a ratio to the bulk volume of the copper powder) of approximately 36(=(8/22.5)×100) vol %.

Example 2

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, a heat transfer pad was prepared in the same way as the above-described EXAMPLE 1.

The poured amount of pentadecane was 5 ml in total. The bulk volume of 75 g of the copper powder was measured through the use of a 50 ml measuring cylinder and found to be 14 ml. In this case, therefore, the addition amount of the heat transfer liquid (pentadecane) relative to the heat transfer powder (copper powder) was at a volume ratio of approximately 36 (=(5/14)×100) vol %.

Example 3

75 g of a copper powder (available from ECKA Granules Germany GmbH) having a manufacturer's indicated particle size of 0.1 mm was weighed out through the use of the above-described electronic scale, and transferred into a B-4 poly bag. Subsequently, a heat transfer pad was prepared in the same way as the above-described EXAMPLE 1.

The poured amount of pentadecane was 5 ml in total. The bulk volume of 75 g of the copper powder was measured through the use of a 50 ml measuring cylinder and found to be 13.5 ml. In this case, therefore, the addition amount of the heat transfer liquid (pentadecane) relative to the heat transfer powder (copper powder) was at a volume ratio of approximately 37 (=(5/13.5)×100) vol %.

Example 4

75 g of a copper powder (available from ECKA Granules Germany GmbH) having a manufacturer's indicated particle size of 0.2 mm was weighed out through the use of the above-described electronic scale, and transferred into a B-4 poly bag. Subsequently, a heat transfer pad was prepared in the same way as the above-described EXAMPLE 1.

The poured amount of pentadecane was 5 ml in total. The bulk volume of 75 g of the copper powder was measured through the use of a 50 ml measuring cylinder and found to be 13.75 ml. In this case, therefore, the addition amount of the heat transfer liquid (pentadecane) relative to the heat transfer powder (copper powder) was at a volume ratio of approximately 36(=(5/13.75)×100) vol %.

Example 5

75 g of a copper powder (available from ECKA Granules Germany GmbH) having a manufacturer's indicated particle size of 0.3 mm was weighed out through the use of the above-described electronic scale, and transferred into a B-4 poly bag. Subsequently, a heat transfer pad was prepared in the same way as the above-described EXAMPLE 1.

The poured amount of pentadecane was 5 ml in total. The bulk volume of 75 g of the copper powder was measured through the use of a 50 ml measuring cylinder and found to be 14.25 ml. In this case, therefore, the addition amount of the heat transfer liquid (pentadecane) relative to the heat transfer powder (copper powder) was at a volume ratio of approximately 35(=(5/14.25)×100) vol %.

Example 6

75 g of a copper powder (purity of 99.9 w %, available from HIKARI MATERIAL INDUSTRY CO., LTD.) having a manufacturer's indicated particle size from 53 to 150 μm (0.053 to 0.15 mm) was weighed out through the use of the above-described electronic scale, and transferred into a B-4 poly bag. Subsequently, a heat transfer pad was prepared in the same way as the above-described EXAMPLE 1.

The poured amount of pentadecane was 5 ml in total. The bulk volume of 75 g of the copper powder was measured through the use of a 50 ml measuring cylinder and found to be 14 ml. In this case, therefore, the addition amount of the heat transfer liquid (pentadecane) relative to the heat transfer powder (copper powder) was at a volume ratio of approximately 36 (=(5/14)×100) vol %.

A heat transfer pad containing only a heat transfer powder (copper powder) or a heat transfer liquid (pentadecane) was prepared as follows.

Comparative Example 1

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, in a state where the air is removed from the bag as much as possible, the bag was sealed to form a final heat transfer pad.

Comparative Example 2

20 ml of pentadecane ($C_{15}H_{32}$) (Wako special grade, available from Wako Pure Chemical Industries, Ltd.) was weighed out through the use of the above-described pipette, and transferred into a B-4 poly bag. Subsequently, in a state where the air is removed from the bag as much as possible, the bag was sealed to form a final heat transfer pad.

A heat transfer pad containing a heat transfer liquid which freezes at a higher temperature than pentadecane was prepared as follows.

Example 7

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, hexadecane ($C_{16}H_{34}$) (Wako special grade, available from Wako Pure Chemical Industries, Ltd.) was dropped in units of 0.5 ml through the use of the above-described pipette while being fitted into the copper powder slowly until a liquid surface was visually recognizable on the surface of the copper powder. Subsequently, 0.5 ml of the hexadecane was further added. Air bubbles in the prepared heat transfer pad were removed sufficiently by methods including applying vibration. In a state where the air is removed from the bag as much as possible, the bag was sealed to form a final heat transfer pad.

The poured amount of hexadecane was 5 ml in total. The bulk volume of 75 g of the copper powder was 14 ml as described above. In this case, therefore, the addition amount of the heat transfer liquid (hexadecane) relative to the heat transfer powder (Cu) was at a volume ratio of approximately 36 (=(5/14)×100) vol %.

Heat transfer pads containing heat transfer liquids which do not freeze at a target temperature (which have freezing points lower than the target temperature) were prepared as follows.

Comparative Example 3

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, silicone oil (AZ silicone oil, available from AZ CO., LTD.) was dropped in units of 0.5 ml through the use of the above-described pipette while being fitted into the copper powder slowly until a liquid surface was visually recognizable on the surface of the copper powder. Subsequently, 0.5 ml of the silicone oil was further added. Air bubbles in the prepared heat transfer pad were removed sufficiently by methods including applying vibration. In a state where the air is removed from the bag as much as possible, the bag was sealed to form a final heat transfer pad.

The poured amount of silicone oil was 5 ml in total. The bulk volume of 75 g of the copper powder was 14 ml as described above. In this case, therefore, the addition amount of the heat transfer liquid (silicone oil) relative to the heat transfer powder (Cu) was at a volume ratio of approximately 36(=(5/14)×100) vol %.

Comparative Example 4

75 g of a copper powder (available from ECKA Granules Germany GmbH) having a manufacturer's indicated particle size of 0.3 mm was weighed out through the use of the above-described electronic scale, and transferred into a B-4 poly bag. Subsequently, a heat transfer pad was prepared in the same way as the above-describe COMPARATIVE EXAMPLE 3.

The poured amount of silicone oil was 5 ml in total. The bulk volume of 75 g of the copper powder was 14.25 ml as described above. In this case, therefore, the addition amount of the heat transfer liquid (silicone oil) relative to the heat transfer powder (copper powder) was at a volume ratio of approximately 35(=(5/14.25)×100) vol %.

Heat transfer pads containing heat transfer powders (metal powders) differing in thermal conductivity from copper (Cu) were prepared as follows.

Example 8

35 g of an aluminum (Al) powder (purity of 99.7 w %, available from HIKARI MATERIAL INDUSTRY CO., LTD.) having a manufacturer's indicated particle size not exceeding 150 μm (not exceeding 0.15 mm) was weighed out through the use of the above-described electronic scale, and transferred into a B-4 poly bag. Subsequently, a heat transfer pad was prepared in the same way as the above-described EXAMPLE 1.

The poured amount of pentadecane was 8 ml in total. The bulk volume of 35 g of the aluminum powder was measured through the use of a 50 ml measuring cylinder and found to be 22 ml. In this case, therefore, the addition amount of the heat transfer liquid (pentadecane) relative to the heat transfer powder (aluminum powder) was at a volume ratio of approximately 36(=(8/22)×100) vol %.

Example 9

75 g of a tin (Sn) powder (available from HIKARI MATERIAL INDUSTRY CO., LTD.) having a manufacturer's indicated particle size not exceeding 150 μm (not exceeding 0.15 mm) was weighed out through the use of the above-described electronic scale, and transferred into a B-4 poly bag. Subsequently, a heat transfer pad was prepared in the same way as the above-describe EXAMPLE 1.

The poured amount of pentadecane was 5.5 ml in total. The bulk volume of 75 g of the tin powder was measured through the use of a 50 ml measuring cylinder and found to be 16.5 ml. In this case, therefore, the addition amount of the heat transfer liquid (pentadecane) relative to the heat transfer powder (tin powder) was at a volume ratio of approximately 33(=(5.5/16.5)×100) vol %.

Example 10

75 g of a zinc (Zn) powder (available from HIKARI MATERIAL INDUSTRY CO., LTD.) having a manufacturer's indicated particle size not exceeding 53 μm (not exceeding 0.053 mm) was weighed out through the use of the above-described electronic scale, and transferred into a B-4 poly bag. Subsequently, a heat transfer pad was prepared in the same way as the above-described EXAMPLE 1.

The poured amount of pentadecane was 7.5 ml in total. The bulk volume of 75 g of the zinc powder was measured through the use of a 50 ml measuring cylinder and found to be 19.25 ml. In this case, therefore, the addition amount of the heat transfer liquid (pentadecane) relative to the heat transfer powder (zinc powder) was at a volume ratio of approximately 39(=(7.5/19.25)×100) vol %.

A plurality of types of heat transfer pads, to each of which was added a different amount of heat transfer liquid (pentadecane), were prepared as follows.

Example 11

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, 1.66 ml of pentadecane ($C_{15}H_{32}$) (Wako special grade, available from Wako Pure Chemical Industries, Ltd.) was dropped through the use of the above-described pipette while being fitted into the copper powder slowly. After agitation was applied well for uniformity, air bubbles in the heat transfer pad were removed sufficiently by methods including applying vibration. In a state where the air is removed from the bag as much as possible, the bag was sealed to form a final heat transfer pad.

The bulk volume of 75 g of the copper powder was 14 ml as described above. In this case, therefore, the addition amount of the heat transfer liquid (pentadecane) relative to the heat transfer powder (Cu) was at a volume ratio of approximately 12(=(1.66/14)×100) vol %.

Example 12

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, 3.33 ml of pentadecane ($C_{15}H_{32}$) (Wako special grade, available from Wako Pure Chemical Industries, Ltd.) was dropped through the use of the above-described pipette while being fitted into the copper powder slowly. After agitation was applied well with a bar for uniformity, air bubbles in the heat transfer pad were removed sufficiently by methods including applying vibration. In a state where the air is removed from the bag as much as possible, the bag was sealed to form a final heat transfer pad.

The bulk volume of 75 g of the copper powder was 14 ml as described above. In this case, therefore, the addition amount of the heat transfer liquid (pentadecane) relative to the heat transfer powder (Cu) was at a volume ratio of approximately 24(=(3.33/14)×100) vol %.

Example 13

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, 3.88 ml of pentadecane ($C_{15}H_{32}$) (Wako special grade, available from Wako Pure Chemical Industries, Ltd.) was dropped through the use of the above-described pipette while being fitted into the copper powder slowly. After agitation was applied well with a bar for uniformity, air bubbles in the heat transfer pad were removed sufficiently by methods including applying vibration. In a state where the air is removed from the bag as much as possible, the bag was sealed to form a final heat transfer pad.

The bulk volume of 75 g of the copper powder was 14 ml as described above. In this case, therefore, the addition amount of the heat transfer liquid (pentadecane) relative to the heat transfer powder (Cu) was at a volume ratio of approximately 28(=(3.88/14)×100) vol %.

Example 14

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, 4.44 ml of pentadecane ($C_{15}H_{32}$) (Wako special grade, available from Wako Pure Chemical Industries, Ltd.) was dropped through the use of the above-described pipette while being fitted into the copper powder slowly. After agitation was applied well with a bar for uniformity, air bubbles in the heat transfer pad were removed sufficiently by methods including applying vibration. In a state where the air is removed from the bag as much as possible, the bag was sealed to form a final heat transfer pad.

The bulk volume of 75 g of the copper powder was 14 ml as described above. In this case, therefore, the addition amount of the heat transfer liquid (pentadecane) relative to the heat transfer powder (Cu) was at a volume ratio of approximately 32(=(4.44/14)×100) vol %.

Example 15

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, 6.66 ml of pentadecane ($C_{15}H_{32}$) (Wako special grade, available from Wako Pure Chemical Industries, Ltd.) was dropped through the use of the above-described pipette while being fitted into the copper powder slowly. Subsequently, air bubbles in the heat transfer pad were removed sufficiently by methods including applying vibration. In a state where the air is removed from the bag as much as possible, the bag was sealed to form a final heat transfer pad.

The bulk volume of 75 g of the copper powder was 14 ml as described above. In this case, therefore, the addition amount of the heat transfer liquid (pentadecane) relative to the heat transfer powder (Cu) was at a volume ratio of approximately 48(=(6.66/14)×100) vol %.

Example 16

75 g of a copper powder (available from ECKA Granules Germany GmbH) having a manufacturer's indicated particle size of 0.07 mm was weighed out through the use of the above-described electronic scale, and transferred into a B-4 poly bag. Subsequently, 8.33 ml of pentadecane ($C_{15}H_{32}$) (Wako special grade, available from Wako Pure Chemical Industries, Ltd.) was dropped through the use of the above-described pipette while being fitted into the copper powder slowly. Subsequently, air bubbles in the heat transfer pad were removed sufficiently by methods including applying vibration. In a state where the air is removed from the bag as much as possible, the bag was sealed to form a final heat transfer pad.

The bulk volume of 75 g of the copper powder was 14 ml as described above. In this case, therefore, the addition amount of the heat transfer liquid (pentadecane) relative to the heat transfer powder (Cu) was at a volume ratio of approximately 60(=(8.33/14)×100) vol %.

The cooling performance (heat transfer performance) of each of the heat transfer pads was measured as follows.

Initially, a heat transfer pad as an object of measurement was placed in such a manner that the center of the filled part of the heat transfer pad is interposed between the shoulder (approximately at a height of 208 mm from the bottom) of an unopened bottled wine (750 ml) (diameter of 72 mm and height of 301 mm) and the low-temperature portion (the heat transfer block of a Peltier unit) of a Peltier cooling tester, which have a configuration similar to the main body 111 shown in FIGS. 1A and 1B. Then, the bottled wine was pressed against the heat transfer pad to achieve an intimate contact therebetween.

Subsequently, a temperature sensor (thermocouple) was affixed to the side surface of the bottled wine at a lower portion thereof (approximately at a height of 20 mm from the bottom). While the temperature is being measured, cooling was conducted from a state at a room temperature. Then, a temperature difference ΔT (=T1−T2) between a temperature T1 at the time when 10 minutes have elapsed from the start of the cooling and a temperature T2 at the time when 60 minutes have elapsed from the start of the cooling was calculated as an index of cooling performance (heat transfer performance).

FIG. 10 is a table showing a measurement result of each heat transfer pad.

As shown in FIG. 10, in comparison with COMPARATIVE EXAMPLE 1 (copper powder alone) and COMPARATIVE EXAMPLE 2 (pentadecane alone), each of EXAMPLES 1 to 16 exhibits relatively high cooling performance (heat transfer performance).

In comparison with COMPARATIVE EXAMPLES 3 and 4 (copper powder+silicone oil), each of EXAMPLES 2, 3, 6 to 10, and 12 to 16 exhibits relatively high cooling performance (heat transfer performance). In particular, regarding each of EXAMPLES 2, 3, 6 to 10, and 13 to 16, ΔT is greater than or equal to 4.0 to exhibit considerably high cooling performance (heat transfer performance).

As understood from the above-described results, in terms of the particle size of a heat transfer powder, a particle size of approximately 0.04 to 0.16 mm can be considered to achieve considerably high cooling performance (heat transfer performance).

In terms of the addition amount of a heat transfer liquid relative to a heat transfer powder, a volume ratio of greater than or equal to 24 vol % can be considered to achieve high cooling performance (heat transfer performance), and a volume ratio of greater than or equal to 28 vol % can be considered to achieve considerably high cooling performance (heat transfer performance). Concerning each of EXAMPLES 15 and 16, deposition of the heat transfer powder (copper powder) was observed in the heat transfer pad, and the deposited part of the heat transfer powder was interposed between the shoulder of the bottled wine and the low-temperature portion of the Peltier cooling tester during the above-described measurements. Therefore, the increase in heat transfer liquid between EXAMPLE 15 and EXAMPLE 16 can be considered to exert little influence on cooling performance (heat transfer performance). EXAMPLE 15 and EXAMPLE 16 actually exhibit the same cooling performance (heat transfer performance). As understood from the foregoing, an addition amount of a heat transfer liquid of approximately 24 to 48 vol % can be considered to achieve high cooling performance (heat transfer performance), and an addition amount of a heat transfer liquid of approximately 28 to 48 vol % can be considered to achieve considerably high cooling performance (heat transfer performance).

In terms of the material of the heat transfer powder, each of the metal types: copper, aluminum, tin, and zinc, achieves considerably high cooling performance (heat transfer performance). Of these metal types, tin has the highest thermal conductivity of 66.8 W/m·K. In view of this, generally, the use of a material having a thermal conductivity of greater than or equal to approximately 60 W/m·K as the material of the heat transfer powder can be considered to achieve high cooling performance (heat transfer performance).

The cooling performance (heat transfer performance) of the heat transfer pad (EXAMPLE 3) was measured with the bottled wine tilted to a predetermined angle as follows.

Figure 11:
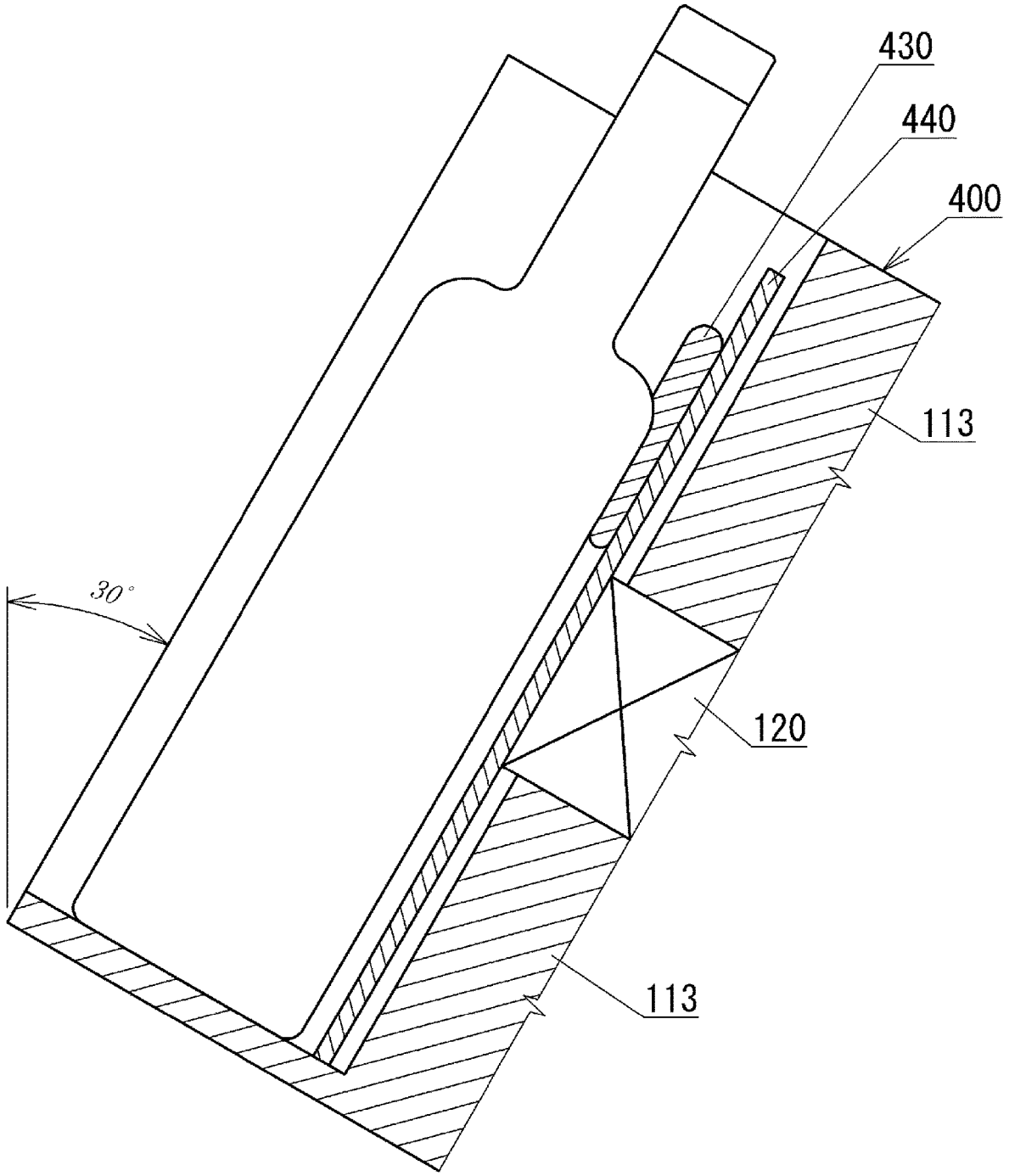
FIG. 11 is a view for explaining a measurement method in a state where a bottled wine is tilted to a predetermined angle.

First, as shown in FIG. 11, a Peltier cooling tester 400 additionally including a heat transfer plate (copper plate of 80 mm×250 mm×5 mm) 440 was tilted to 30° from the vertical direction. Then, the heat transfer pad 430 of EXAMPLE 3 was placed in such a manner that the center of the filled part of the heat transfer pad 430 is interposed between the shoulder (approximately at a height of 208 mm from the bottom) of an unopened bottled wine (750 ml) (diameter of 72 mm and height of 301 mm) and the heat transfer plate 440. Then, the bottled wine was pressed against the heat transfer pad 430 to achieve a tight contact therebetween.

Next, a temperature sensor (thermocouple) was affixed to each of a side surface area A (approximately at a height of 20 mm from the bottom) and a side surface area B (approximately at a height of 100 mm from the bottom) at a lower portion of the bottled wine. While the temperature was being measured, cooling was conducted from a state at a room temperature. Then, a temperature difference ΔT (=T1−T2) between a temperature T1 at the time when 10 minutes have elapsed from the start of the cooling and a temperature T2 at the time when 60 minutes have elapsed from the start of the cooling was calculated as an index of cooling performance (heat transfer performance).

Likewise, the Peltier cooling tester 400 was tilted to 45° and 60°. Then, the measurement was made in the same way in each of these cases to calculate ΔT.

FIG. 12 is a table showing the results of the measurement.

As shown in FIG. 12, in comparison to the case of tilting the bottled wine greatly (tilt angle of 60°), high cooling performance is achieved in the cases of not tilting the bottled wine greatly (tilt angle of 30° and tilt angle of 45°).

This can be considered to result from the fact that, in the configuration shown in FIG. 11, tilting the bottled wine greatly causes difficulty in forming convection inside the bottle, thereby reducing cooling efficiency.

In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

REFERENCE NUMERALS

1 Bottled wine
100 Wine temperature adjustment apparatus
110 Bottle-accommodating portion
111 Main body
112 Cover
113 Heat insulator
114 Hinge mechanism
115 Flat spring
120 Peltier unit
121 Heat transfer block
1211 Upper surface
122 Radiating fin
1221 Rectangular plate
1222 Fin
123 Casing
1231 Side wall portion
1232 Projecting portion
124 Thermoelectric conversion module
125 Tab terminal
126 Lead wire
130 Heat transfer pad
200 Wine temperature adjustment apparatus
230 Heat transfer pad
240 Heat transfer plate
300 Wine temperature adjustment apparatus
331-336 Heat transfer pad
400 Peltier cooling tester
430 Heat transfer pad
440 Heat transfer plate

610 π-shaped thermoelectric element
611 N-type semiconductor element
612 P-type semiconductor element
613, 620 Metal electrode
630 Insulating substrate
900 Control system
910 Temperature detection portion
911 Bottled-wine temperature detector
912 Heat-transfer-block temperature detector
920 Operation portion
930 Controller
940 Temperature adjustment unit
950 Display portion

The invention claimed is:

1. A beverage temperature adjustment apparatus, comprising:

a heat transfer member comprising a deformable bag body that contains a heat transfer powder and a heat transfer liquid, the heat transfer member capable of abutting a part of a side surface of a beverage container to adjust a temperature of a beverage in the beverage container; and a temperature adjustment element configured to adjust the temperature of the beverage in the beverage container through the heat transfer member, wherein the heat transfer liquid is a liquid which freezes at a temperature higher than a target temperature of a beverage in the beverage container, and wherein an amount of the heat transfer liquid relative to an amount of the heat transfer powder is within a range of approximately 24% to 48% by volume.

2. The beverage temperature adjustment apparatus according to claim 1, further comprising:

a biasing portion configured to place the beverage container and the heat transfer member in abutting contact with each other.

3. The beverage temperature adjustment apparatus according to claim 1, wherein the part of the side surface of the beverage container is an upper part of the side surface of the beverage container.

4. The beverage temperature adjustment apparatus according to claim 1, wherein the part of the side surface of the beverage container includes an upper part and a lower part of the side surface of the beverage container.

5. The beverage temperature adjustment apparatus according to claim 4, wherein the heat transfer member is a first heat transfer member, the apparatus further comprising:

a second heat transfer member disposed between the first heat transfer member and the temperature adjustment element.

6. The beverage temperature adjustment apparatus according to claim 1, wherein the heat transfer member is one of a plurality of heat transfer members, and wherein the plurality of heat transfer members are arranged at intervals in a longitudinal direction of the beverage container.

7. The beverage temperature adjustment apparatus according to claim 6, wherein the plurality of heat transfer members are a plurality of first heat transfer members, the apparatus further comprising:

a second heat transfer member disposed between the plurality of first heat transfer members and the temperature adjustment element.

8. The beverage temperature adjustment apparatus according to claim 1, wherein the apparatus is configured to freeze the heat transfer liquid and maintain the heat transfer liquid in a frozen state while the temperature of the beverage in the beverage container is adjusted.

9. The beverage temperature adjustment apparatus according to claim 1, wherein the temperature adjustment element is configured to heat the heat transfer member to convert the heat transfer liquid from a frozen state to a liquid state before an adjustment of the temperature of the beverage in the beverage container is started.

10. The beverage temperature adjustment apparatus according to claim 1, wherein the heat transfer powder includes metal powder.

11. The beverage temperature adjustment apparatus according to claim 1, wherein the heat transfer liquid includes any one of: straight-chain hydrocarbon; primary alcohol; straight-chain aldehyde; and straight-chain carboxylic acid.

12. The beverage temperature adjustment apparatus according to claim 1, wherein the amount of the heat transfer liquid relative to the amount of the heat transfer powder is a ratio at which the heat transfer powder and the heat transfer liquid exist in a capillary state.

13. The beverage temperature adjustment apparatus according to claim 1, wherein the amount of the heat transfer liquid relative to the amount of heat transfer powder is within a range of approximately 28% to 48% by volume.

14. The beverage temperature adjustment apparatus according to claim 1, wherein the heat transfer powder has a particle size within a range of 0.04 to 0.16 mm.

15. A heat transfer member to be used for adjusting a temperature of an object to a target temperature, the heat transfer member comprising:

a deformable bag body;

a heat transfer powder contained in the bag body; and a heat transfer liquid contained in the bag body, the heat transfer liquid being a liquid that freezes at a temperature higher than the target temperature, and an amount of the heat transfer liquid relative to an amount of the heat transfer powder being within a range of approximately 24% to 48% by volume.

16. The heat transfer member according to claim 15, wherein the heat transfer powder includes metal powder.

17. The heat transfer member according to claim 15, wherein the heat transfer liquid includes any one of: straight-chain hydrocarbon; primary alcohol; straight-chain aldehyde; and straight-chain carboxylic acid.

18. The heat transfer member according to claim 15, wherein the amount of the heat transfer liquid relative to the amount of the heat transfer powder in the bag body is a ratio at which the heat transfer powder and the heat transfer liquid exist in a capillary state.

19. The heat transfer member according to claim 15, wherein the amount of the heat transfer liquid relative to the amount of the heat transfer powder in the bag body is within a range of approximately 28% to 48% by volume.

20. The heat transfer member according to claim 15, wherein the heat transfer powder has a particle size within a range of 0.04 to 0.16 mm.

* * * * *